US007195023B2

(12) United States Patent
McKee et al.

(10) Patent No.: US 7,195,023 B2
(45) **Date of Patent: *Mar. 27, 2007**

(54) RAPID RESIDENTIAL DISHWASHER

(75) Inventors: Philip R. McKee, Frisco, TX (US); Florence C. Hergenrether, Dallas, TX (US)

(73) Assignee: Appliance Scientific, Inc., Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/027,003

(22) Filed: Dec. 30, 2004

(65) Prior Publication Data

US 2005/0150527 A1 Jul. 14, 2005

Related U.S. Application Data

(63) Continuation-in-part of application No. 10/865,473, filed on Jun. 10, 2004, which is a continuation-in-part of application No. 10/764,183, filed on Jan. 23, 2004, which is a continuation-in-part of application No. 10/382,424, filed on Mar. 6, 2003, now Pat. No. 6,821,354, which is a continuation of application No. 09/733,169, filed on Dec. 8, 2000, now Pat. No. 6,550,488.

(51) Int. Cl.
*B08B 3/10* (2006.01)

(52) U.S. Cl. ..... 134/57 D; 134/105; 134/108; 134/111; 134/113

(58) Field of Classification Search ..... 134/56 R, 134/57 D, 56 D, 105, 108, 111, 113
See application file for complete search history.

(56) References Cited

U.S. PATENT DOCUMENTS

| | | | | |
|---|---|---|---|---|
| 1,771,524 | A * | 7/1930 | Brotz | 134/186 |
| 2,671,455 | A * | 3/1954 | Macdonald et al. | 134/57 DL |
| 2,781,765 | A * | 2/1957 | Steidley | 134/57 D |
| 2,881,780 | A * | 4/1959 | Johnson et al. | 137/132 |
| 2,956,572 | A * | 10/1960 | Levit et al. | 134/176 |
| 3,026,628 | A * | 3/1962 | Berger, Sr. et al. | 34/231 |
| 3,043,724 | A * | 7/1962 | Bunn | 134/25.2 |
| 3,049,133 | A * | 8/1962 | Jacobs | 134/57 D |
| 3,083,717 | A | 4/1963 | Bear | |
| 3,514,330 | A * | 5/1970 | Leedy et al. | 134/115 R |
| 3,519,796 | A * | 7/1970 | Bebinger | 392/463 |
| 3,874,927 | A * | 4/1975 | Willard, Sr. | 502/243 |
| 4,289,543 | A * | 9/1981 | Vallor | 134/25.2 |

(Continued)

FOREIGN PATENT DOCUMENTS

EP 0 086 037 A1 8/1983

(Continued)

OTHER PUBLICATIONS

NSF International Standard/American National Standard "Commercial Warewashin Equipment" May 23, 2001.*

(Continued)

*Primary Examiner*—Frankie L. Stinson
(74) *Attorney, Agent, or Firm*—Amster, Rothstein and Ebenstein LLP

(57) ABSTRACT

A dishwasher that fits within the conventional U.S. residential dishwasher counter space and uses the conventional U.S. residential power supply to achieve within a convenient cycle time the same standard of sanitation as set forth for commercial and residential hot water sanitizing dishwashers.

13 Claims, 10 Drawing Sheets

U.S. PATENT DOCUMENTS

| | | | | |
|---|---|---|---|---|
| 4,641,671 | A * | 2/1987 | Nogi et al. | 134/57 D |
| 5,511,570 | A * | 4/1996 | Noren et al. | 134/105 |
| 5,534,078 | A * | 7/1996 | Breunsbach | 134/10 |
| 5,711,325 | A * | 1/1998 | Kloss et al. | 134/104.1 |
| 6,267,894 | B1 * | 7/2001 | Guldi et al. | 210/739 |
| 6,474,289 | B1 * | 11/2002 | Lilly et al. | 123/198 D |
| 6,615,850 | B1 * | 9/2003 | Hornung | 134/57 R |

FOREIGN PATENT DOCUMENTS

| | | |
|---|---|---|
| JP | 06-327604 | 11/1994 |

OTHER PUBLICATIONS

NSF International Standard/American National Standard "Residential Dishwashers" Nov. 5, 2001 2001.*

* cited by examiner

WASH/RINSE CYCLE

RAPID RESIDENTIAL DISHWASHER

CROSS-REFERENCE TO RELATED APPLICATIONS

This is a continuation-in-part of U.S. patent application Ser. No. 10/865,473, filed Jun. 10, 2004, itself a continuation-in-part of U.S. patent application Ser. No. 10/764,183, filed Jan. 23, 2004, itself a continuation-in-part of U.S. patent application Ser. No. 10/382,424, filed Mar. 6, 2003, now U.S. Pat. No. 6,821,354, itself a continuation of U.S. patent application Ser. No. 09/733,169, filed Dec. 8, 2000, now U.S. Pat. No. 6,550,448.

BACKGROUND OF THE INVENTION

The present invention relates to a dishwasher, and more particularly to a dishwasher which fits within the counter space typically available for a U.S. residential dishwasher and is operable on a U.S. residential power supply, yet meets the high sanitary requirements of a commercial dishwasher within a convenient cycle time.

Washing involves subjecting the surfaces of the dishes to sprays of a hot water and detergent solution for the purpose of removing food, grease, and other soiling material. Rinsing is the application of hot water to the surfaces of clean dishes.

Etching is a problem with glassware. Etching is the process through which a cloudy film develops on glasses over time. Etching is caused by a combination of several factors, including water softness, detergent, temperature and length of time at which the glassware is exposed to elevated temperatures. Given that detergent and water softness are relatively constant for a residential dishwasher application, it is desirable to avoid holding glassware under high temperatures for extended periods of time. Preferably, dishwashers should not subject glassware to temperatures over roughly 150° F. (66° C.) for longer than roughly 20 minutes or they may induce an unacceptable amount of etching. These standards are not specifically defined, however, since the exact conditions under which etching occurs are not precisely known and vary for different glassware products.

A commercial hot water sanitizing dishwasher must comply with the joint International Standard set by the NSF (National Sanitation Federation) and ANSI (American National Standard Institute)—namely, NSF/ANSI 3-2001. This commercial hot water sanitizing dishwashing machine standard is postulated in terms of three tests: First, the complete cycle shall render dishes free of soil and detergents. Second, the complete cycle shall deliver a minimum of 3,600 HUEs (heat unit equivalents at the surface of the dishes), with varying amounts of HUEs (as set forth in a chart) being added for each second that the surface of the dishes is at a temperature above 143° F. during the rinse cycles. Third, for a hot water sanitizing machine having a stationary rack (as opposed to a conveyer) the machine shall provide either a single temperature of 165° F. (74° C.) for both the minimum wash temperature and the minimum rinse temperature or a dual temperature of 150° F. (66° C.) for the minimum wash temperature and 180° F. (82° C.) for the minimum sanitizing rinse temperature. In both instances, if line pressure is relied upon, the sanitizing rinse pressure should be 20 psi±5 psi (138 kPa±34 kPa).

Accordingly, most commercial hot water sanitizing dishwashers today (e.g., a door-type Jackson TEMPSTAR dishwasher) use a fairly high volume (e.g., about eight gallons) of recirculating water under fairly high pressure (about 20 psi) at at least 150° F. to wash for roughly about 45–48 seconds, then rinse with water at at least 180° F. for roughly about 11–12 seconds (346.8 HUEs/sec.). Such dishwashers have a complete cycle time of about one minute, generate between 3,815–4,161 HUEs, and are said to operate under the dual temperature (150° F./180° F. wash/rinse) implementation of the commercial sanitization standard. However, other commercial hot water sanitizing dishwashers implement the sanitization standard by using 165° F. water for both the wash cycle and the rinse cycle. As all temperatures above 165° F. have a value of 346.8 HUEs, a rinse period of 11 seconds at at least 165° F. generates about 3,814 HUES. Such dishwashers are said to operate under the single temperature (165° F./165° F. wash/rinse) implementation of the sanitization standard. If the temperature of the dishes lags the temperature of the rinse water, additional time (e.g., 20 seconds) may be required to reach the minimum 3,600 HUEs necessary to achieve the sanitization standard.

Commercial dishwashers in the United States (and even residential dishwashers in many European countries) are capable of meeting such stringent requirements in minutes or less since they have available to them an ample electrical supply (e.g., a 220/240 volt, 30–40 amp power supply). On the other hand, a residential dishwasher in the United States typically has available to it only the customary 110–120 volt, 15–20 amp household power supply. Accordingly, the conventional U.S. residential dishwashing systems cannot attain either the 150° F./180° F. or the 165° F./165° F. implementation of the sanitization standard for U.S. commercial dishwashers unless the dishwasher cycle extends for an inordinate amount of time, presumably at least about 90 minutes. The hot water available to a U.S. residential dishwasher is typically at 120° F.–140° F., 120° F. being the most common and 140° F. being the common practical maximum. Accordingly, unless there is a dedicated hot water heater external of the dishwasher to increase the temperature of the hot water supply available to the dishwasher, it is difficult, if not impossible, for the dishwasher—by virtue of its sump reheater alone—to raise the surface temperature of the dishes to above 143° F. and maintain them at that temperature (as necessary to accumulate HUEs) within an acceptable time for a normal residential dishwashing cycle. Thus, for the most part, U.S. residential dishwashers operating under their "normal" wash cycle, even those taking an hour or so for the complete cleaning cycle, typically do not accumulate any HUEs, let alone enough to meet the sanitization standard.

Some residential dishwasher manufacturers offer a "sanitizing rinse" which extends the rinse cycle as required to achieve 3,600 HUEs. Because the residential hot water sanitizing standard (NSF/ANSI 184-2001) eliminates the single and dual temperature requirements, those dishwashers are said to comply with the residential sanitization standard. However, the extension of the rinse cycle to achieve the required 3,600 HUE's causes the total operating cycle time to extend to at least about 70 minutes which is inordinately long.

Informal industry standards and experience for U.S. residential dishwashers dictate, first, that there be at least three, and typically four, cycles—including a bathe or pre-wash cycle, at least one wash cycle, and at least one (preferably two) rinse cycles—to achieve effective cleaning of soiled kitchenware. Each cycle typically requires at least 1.5 gallons of water, typically 1.5–2.0 gallons, in order to obtain the desired cleaning. Second, the dishwasher must be able to operate with the limited U.S. residential power supply (110–120 volt, 15–20 amp power supply) and with the common maximum hot water supply available thereto (140° F.). Third, the dishwasher must operate within a convenient cycle time, and in any case a cycle time which does not involve subjecting glassware to temperatures over roughly 150° F. for longer than about twenty minutes in order to avoid etching of the glassware. Taken in combination, these three informal industry standards—four cycles, limited power, and limited time—pose rather difficult restrictions on the U.S. residential dishwasher, as each of the four cycles involves the introduction of at least 1.5 gallons of water at a maximum of 140° F., which water must be brought up to a higher temperature within a limited period of time using a limited power supply. Complicating the problem of bringing the water to appropriate sanitizing temperatures is the fact that each cycle of the U.S. residential dishwasher—whether bathe, wash, or rinse—begins with the introduction of water which is typically at a maximum of 140° F. The conventional heating element in the recirculating sump of the U.S. residential dishwasher has available to it only about 800 Watts of power (that is, the standard U.S. residential electrical power input minus the amount of power required to run the sump recirculating pump and controls).

The conventional heating element of a dishwasher (located in the recirculating sump) must raise the temperature of not only the 1.5–2.0 gallons of water present in a given cycle (equivalent to 12–16 lbs. of water), but also the kitchenware to be cleaned, including dishes, pots, pans, silverware and like kitchen utensils (typically about 20–30 lbs.), and the cavity/rack/spray-on system of the dishwashing cavity (typically about another 46–63 lbs.). In summary, the sump heating element can typically provide an increase in temperature of the system (that is, the approximately 78–109 lbs. of water, kitchenware to be washed, and dishwasher cavity surfaces) of about 1° F. per minute. The power supply must not only feed such heating element, but also perform the non-heating functions of the dishwasher—e.g., driving the pump that circulates the water under pressure into and around the cavity, driving the controls of the consumer interface, and the like. Thus it is not surprising that the time required to meet either implementation of the commercial sanitization standard would be longer than an hour for a U.S. residential dishwasher.

The time required for a sanitizing cycle is determined by various variables. A prime variable is the hot tap water temperature—that is, the temperature of the water entering the dishwasher from the hot water tap. The U.S. Department of Energy urges that the water heater of a residence be set at no more than 120° F. However this variable is dependent upon household use of the hot water shortly prior to initiation of the preheat cycle (e.g., for pre-dinner bathing of children) as these demands upon the system may result in only a limited quantity of available hot tap water at 120° F. Another significant variable relates to the nature of the tub construction, the conventional stainless steel tub wash system weighing about 63 lbs of high heat capacity metal and the newer plastic tub wash system weighing about 46 lbs of a plastic having a lower heat capacity than metal and thus providing superior insulation. A final significant variable is the dishwasher load which is set by the AHAM standard at about 32 lbs, but may typically be as low as 16 lbs when the racks are not filled completely with kitchenware or where lightweight plastic kitchenware replaces heavier earthenware kitchenware.

Separate and apart from the constraint imposed on a U.S. residential dishwasher by the limited power supply available, there is also a constraint on the size or volume of a U.S. residential dishwasher. Both builder-supplied dishwashers (for new home construction) and replacement dishwashers are expected to fit within a given volume of "cabinet space," which has become standardized over time at about 35"× 24"×23" to provide a dishwasher enclosure of about 11 cubic feet. The standard volume evolved in a way that allowed the dishwasher to fit under a counter at the standard kitchen counter height, with a door at a height at which consumers felt comfortable loading dishes, and a combined height and width that didn't take up too much cabinet space yet held a reasonable number of dishes. Taking into account the height of the lower tray rollers, the thickness of the door itself, and the space between the bottom of the lower tray and the bottom of the dishwasher cavity leaves approximately 6.8–7.4 inches between the floor and the bottom of the dishwashing cavity (about 4.8–6.0 inches for a "tall tub" dishwasher). Within this limited height must fit most of the working parts of the dishwasher (e.g., inlet water connection, electrical power connection, inlet water valve, motor, valves, hoses, controls, etc.) external of the dishwashing cavity. Any advancement in dishwashers which does not fit within the existing industry standard for cabinet space will simply not be commercially viable. Fortunately, due to technological advances in plastics forming, motor controls and the like, the size of the working parts of dishwashers has shrunk over time since their introduction, and, as a result, some of the space under the dishwashing cavity and above the floor is now available for improvements in the residential dishwasher.

Accordingly, it is an object of the present invention to provide a sanitizing dishwasher which in one preferred embodiment operates on a conventional U.S. residential power supply.

A further object is to provide such a dishwasher which in one preferred embodiment occupies only the conventional U.S. residential dishwasher cabinet space.

Another object is to provide such a dishwasher which in one preferred embodiment surpasses the joint NSF/ANSI standard for commercial hot water sanitizing dishwashers.

It is also an object of the present invention to provide a dishwasher which in one preferred embodiment has a cleaning cycle which is effective for commercial sanitization purposes, yet shorter in length than the non-sanitizing cleaning cycle of the conventional U.S. residential dishwasher.

It is another object to provide such a dishwasher which in a preferred embodiment fits within the conventional U.S. residential dishwasher cabinet space and uses the conventional U.S. residential power supply, but achieves within a convenient cycle time the same standard of sanitization as is set for commercial hot water sanitizing dishwashers.

It is yet another object to provide such a dishwasher which in a preferred embodiment achieves a residential hot water sanitizing standard in less than 15 minutes.

It is a further object to provide such a dishwasher which is simple and inexpensive to manufacture, use and maintain.

SUMMARY OF THE INVENTION

It has now been found that the above and related objects of the present inventions are obtained in a dishwasher comprising means for receiving power from a 110–120 volt, 15–20 amp power supply, a washing chamber including at least one spray head and a recirculatory and reheating sump, and a rack configured and dimensioned to be received within the washing chamber for holding kitchenware to be bathed, washed, rinsed and optionally cooled. The dishwasher further comprises a vented hot water tank substantially disposed beneath the washing chamber, first means for providing communication between a fresh water supply providing water at no more than 140° F. and the tank, and second means for providing communication between the fresh water supply and the washing chamber during selected ones of the bathe, wash, rinse and optional cooling cycles. Actuatable preheat means are provided for introducing water from the fresh water supply into the tank and for using power from the power supply to heat the received water in the tank to at least 170°–190° F. (and preferably 205° F.) prior to commencement of selected ones of the bathe, wash and rinse cycles. Pump means are preferably provided for using power from the power supply for forcing heated water from the tank into the washing chamber for spraying the heated water onto the kitchenware on the rack via the at least one spray head. The dishwasher has at least one of two alternative post-preheat cleaning modes as follows: (i) a first cleaning mode including washing the kitchenware with water at at least 150° F. during a wash cycle, and rinsing the washed kitchenware with water at at least 180° F. during a rinse cycle, and (ii) a second cleaning mode including washing the kitchenware with water at at least 165° F. during a wash cycle, and rinsing the washed kitchenware with water at at least 165° F. during a rinse cycle.

Preferably each cleaning mode provides at least 60,000 Heat Unit Equivalents or HUEs, as defined by the National Sanitation Federation, within a 3 minute rinse cycle.

In a preferred embodiment the dishwasher includes manually operable means for actuating the preheat means. Preferably, the dishwasher is also in operative communication with an otherwise distinct and separate actuatable cooking apparatus (e.g., a stove), the dishwasher including means for actuating the preheat means in response to activation of the cooking apparatus. The operative communication is typically over-the-air or by a wire connection. Either the dishwasher includes means for over-the-air sensing of operation of the cooking apparatus or the cooking apparatus includes a transmitter for transmitting a signal indicating actuation of the cooking apparatus, and the dishwasher includes a receiver for receiving the signal transmitted by the cooking apparatus transmitter. In either case, manually operable means are also provided in the dishwasher for actuating the preheat means independently of the cooking apparatus.

In another preferred embodiment, the preheat means, upon actuation and prior to an initial at least partial deactuation, operates for no more than 45 minutes when supplied by the typical 120°–140° F. household hot water supply (although it may take longer if the household hot water supply is at a lower temperature than 120° F.). The preheat means, for a predetermined period after deactuation, also uses power from the power supply to maintain the heated water in the tank at at least 170°–190° F. (and preferably 205° F.), as necessary, prior to the initial discharge of any substantial quantity of heated water therefrom into the washing chamber. The pump means discharges a substantial quantity of heated water from the tank into the washing chamber, and recirculation begins only subsequent to an initial at least partial deactuation of the preheat means. The dishwasher includes means to preclude operation of selected ones of the bathe, wash and rinse cycles until deactuation of the preheat means. The tank preferably vents water vapor from within the tank into the washing chamber.

The hot water tank has a fluid capacity of about 4.5 to about 5.4 gallons in a small tank embodiment and about 5.5 to about 7.0 gallons in a large tank embodiment. The pump means pumps from the tank less than 1.5 gallons of heated water during the bathe cycle (preferably none in the small tank embodiment), about 1.5–2.0 gallons thereof in the wash cycle, and about 1.5–2.0 gallons thereof in each rinse cycle.

In a further preferred embodiment, the first cleaning mode is completed, post preheating, within 30 minutes, preferably within 15 minutes. During the first cleaning mode, water leaving the at least one spray head reaches at least 180° F., preferably at least 190° F., during at least one of the bathe, wash or rinse cycles. During the first cleaning mode, the surface temperature of the kitchenware is raised to at least about 165–175° F. during at least one of the cycles, and preferably at least about 175° F. during a rinse cycle. During either cleaning mode, the surface temperature of any glassware in the kitchenware is raised to above 160° F. for no more than 9 minutes and above 150° F. for no more than 20 minutes, thereby to minimize etching of the glassware. There may be an optional post-rinse cooling cycle wherein the rinsed kitchenware on the rack is cooled using water from the fresh water supply via the at least one spray head.

The present invention further encompasses a dishwasher meeting the residential (but not commercial) hot water sanitizing standard. This dishwasher comprises a means for receiving power from a 110–120 volt, 15–20 amp power supply, a washing chamber including a spray head and a recirculatory and reheating sump, and a rack configured and dimensioned to be received within the washing chamber for holding kitchenware to be bathed, washed, rinsed and optionally cooled. A pump means uses energy from the power supply for spraying heated water onto the kitchenware on the rack via the spray head. An actuatable preheat means is disposed substantially externally of the washing chamber for receiving energy from the power supply during a preheat cycle and for distributing quantities of the received energy as heat into water external of said washing chamber prior to initial entry of the heated water at at least 150° F. (preferably at least 160° F.) into said washing chamber during selected ones of the bathe, wash and rinse cycles. Communication means provides communication between a fresh water supply providing water at no more than 140° F. and the preheat means. The dishwasher has a post-preheat cleaning mode as follows:

(i) washing the kitchenware with heated water at at least 135° F. during a wash cycle, and (ii) then rinsing the washed kitchenware with heated water at at least 150° F. during a rinse cycle of sufficient duration to develop at least 3,600 HUEs (preferably in less than 6 minutes).

In a preferred embodiment, actuatable preheat means comprises a heat sink means for heating water passing therethrough on the fly, a water tank for heating water stored therein, or both a water tank for heating water stored therein and a heat sink for heating water from the water tank passing therethrough on the fly.

The dishwasher preferably includes means for providing communication between the fresh water supply and the washing chamber during selected ones of the bathe, wash, rinse and optional cooling cycles. The preheat means distributes quantities of the received energy as heat into water external of the washing chamber prior to entry of the heated water at at least 170°–190° F. into the washing chamber.

The present invention extends also to a method of operating a dishwasher on a 110–120 volt, 15–20 amp power supply, and in particular the improvement comprising the steps of providing a dishwasher having at least three alternative modes of operation as follows: (i) a normal non-sanitizing operation (ii) a residential sanitizing operation meeting the joint NSF/ANSI 184-2001 standard for residential hot water sanitizing, and (iii) a commercial sanitizing operation meeting the joint NSF/ANSI 3-2001 standard for commercial hot water sanitizing. The desired mode of operation in then selected. Preferably, after the preheat cycle, the residential sanitizing operation requires not more than 30 minutes.

Alternatively, the improvement comprises the steps of supplying a dishwasher having at least two alternative modes of operation as follows: (i) a normal non-sanitizing operation, and (ii) a commercial sanitizing operation meeting the joint NSF/ANSI 3-2001 standard for commercial hot water sanitizing. The desired mode of operation is then selected.

As yet another alternative, the improvement comprises the steps of supplying a dishwasher having at least two alternative modes of operation as follows: (i) a normal non-sanitizing operation, and (ii) a residential sanitizing operation meeting the joint NSF/ANSI 184-2001 standard for residential hot water sanitizing, the residential sanitizing operation requiring not more than 30 minutes after the preheat cycle. The desired mode of operation is then selected.

The present invention extends further to a method of operating a dishwasher receiving power from a 110–120 volt, 15–20 amp power supply, and in particular the improvement comprising the steps of, during a preheat cycle, introducing water from a fresh water supply at no more that 140° F. into a water tank disposed internally of the dishwasher enclosure but substantially externally of the washing chamber, and using energy from the power supply to heat the water in the tank to at least 170°–190° F. (preferably 205° F.) prior to commencement of selected ones of the bathe, wash and rinse cycles. The next step is commencing selected ones of the bathe, wash and rinse cycles, including washing the kitchenware in the washing chamber with water from the tank at at least 135° F. during a wash cycle, and then rinsing the washed kitchenware with water from the tank at at least 150° F. during a rinse cycle. Preferably the selected cycles include washing the kitchenware in the washing chamber with water from the tank at at least 150° F. during a wash cycle, and then rinsing the washed kitchenware in the washing chamber with water from the tank at at least 180° F. during a rinse cycle.

The present invention further extends to a method of operating a dishwasher receiving power from a 110–120 volt, 15–20 amp power supply, and in particular the improvement comprising the steps of, during a preheat cycle, introducing water from a fresh water supply at no more that 140° F. into a water tank disposed internally of the dishwasher enclosure but substantially externally of the washing chamber of the dishwasher, storing energy from the power supply in at least one energy storage medium disposed internally of the dishwasher enclosure but substantially externally of the washing chamber, and using the stored energy to heat the water in the tank to at least 170°–190° F. (preferably 205° F.) prior to commencement of selected ones of the bathe, wash and rinse cycles. The next step is commencing selected ones of the bathe, wash and rinse cycles, including washing the kitchenware in the washing chamber with water at at least 130° F. during a wash cycle, and then rinsing the washed kitchenware in the washing chamber with water at at least 150° F. during a rinse cycle. Preferably, the selected cycles include washing the kitchenware in the washing chamber with water at at least 150° F. during a wash cycle, and then rinsing it with water at at least 180° F. during a rinse cycle.

In a preferred embodiment, the at least one energy storage medium is selected from the group consisting of the water in the tank, the energy storage mass of a booster/heat sink disposed internally of the dishwasher enclosure, and a combination thereof. During the preheat cycle, preferably the energy is stored in at least two different types of storage media.

The present invention also encompasses a method of operating a dishwasher receiving power from a 110–120 volt, 15–20 amp power supply, and in particular the improvement comprising the steps of, during a preheat cycle, introducing water from a fresh water supply at no more that 140° F. into a water tank disposed internally of the dishwasher enclosure but substantially externally of the washing chamber, and using energy from the power supply to heat the water in the tank to at least 170°–190° F. (preferably 205° F.) prior to introducing the heated water into the washing chamber during selected ones of the optional bathe, wash, optional initial rinse and final rinse cycles; and. Then selected ones of the cycles are commenced including washing the kitchenware in the washing chamber with water from the tank at at least 135° F. during the wash cycle, and then rinsing the washed kitchenware with water from the tank at at least 150° F. during the final rinse cycle, and introducing water from the fresh water supply at no more than 140° F. directly into the washing chamber both during the optional bathe cycle and during the optional initial rinse cycle. Preferably the selected cycles include washing the kitchenware in the washing chamber with water from the tank at at least 150° F. during the wash cycle, and then rinsing the washed kitchenware in the washing chamber with water from the tank at at least 180° F. during the final rinse cycle.

The present invention further extends to a dishwasher having means for determining the soil load level of the kitchenware in the washing chamber and, where appropriate, in response thereto modifying the tank fill step.

In a preferred embodiment, the determining and modifying means, upon determining a low soil load level, modifies the tank fill step such that the actuatable preheat means introduces water from the fresh water supply into the tank via the first communication means only to substantially less than the full capacity of the tank. Alternatively or in addition thereto, the determining and modifying means, upon determining a high soil load level, after commencement of a first wash cycle using substantially all of the heated water in the tank, introduces additional water from the fresh water supply into the tank to refill the tank in a tank refill step and then heats the refill water in the tank to 190°–205° F. for use in the final rinse cycle. Means are provided for postponing initiation of the final rinse cycle until the water in the tank is at 190°–205° F. Where the tank has a water capacity of 1.5–2.0 gallons, the determining and modifying means preferably introduces and heats the tank refill water to 190°–205° F. during at least a portion of the combined duration of the wash and initial rinse cycles.

In another preferred embodiment, where the tank has a water capacity of 3.0–4.4 gallons, the determining and modifying means, upon determining a high soil load level, after commencement of a first wash cycle using substantially less than all of the heated water in the tank, introduces additional water from the fresh water supply into the tank to refill the tank in a tank refill step and then heats the water in the tank to 190°–205° F. for use partially in a second wash cycle and partially in a final rinse cycle. Means are provided for postponing initiation of the second wash cycle until the water in the tank is at 190°–205° F. after the tank refill step. More particularly, the determining and modifying means, upon determining a high soil load level, (A) passes about the half of the heated water from the tank into the washing chamber during the first wash cycle; (B) replaces the heated water passed from the tank into the washing chamber with additional water from the fresh water supply; (C) during the first wash cycle, heats the water in the tank to 190°–205° F. for use partially in a second wash cycle and partially in the final rinse cycle; and (D) initiates the second wash cycle, where necessary postponing initiation of the second wash cycle until the water in the tank is at 190°–205° F.

The present invention encompasses a dishwasher comprising a filter system including a fine filter and a relatively coarse filter disposed in parallel within the flow path of the water recirculated into a washing chamber by a recirculatory and reheating sump; and channeling means for channeling the water in the flow path through a different one of the filters.

In a preferred embodiment, the channeling means channels the water in the flow path substantially only through the fine filter during a final rinse cycle. Where the dishwasher includes a soil load level sensor, and the channeling means is responsive to the sensed soil load level in the water in the flow path. Alternatively, the channeling means is responsive to the temperature of the water in the flow path.

BRIEF DESCRIPTION OF THE DRAWING

The above and related objects, features and advantages of the present invention will be more fully understood by reference to the following detailed description of the presently preferred, albeit illustrative, embodiments of the present invention when taken in conjunction with the accompanying drawing wherein.

DETAILED DESCRIPTION OF THE PREFERRED EMBODIMENTS

Figure 1:
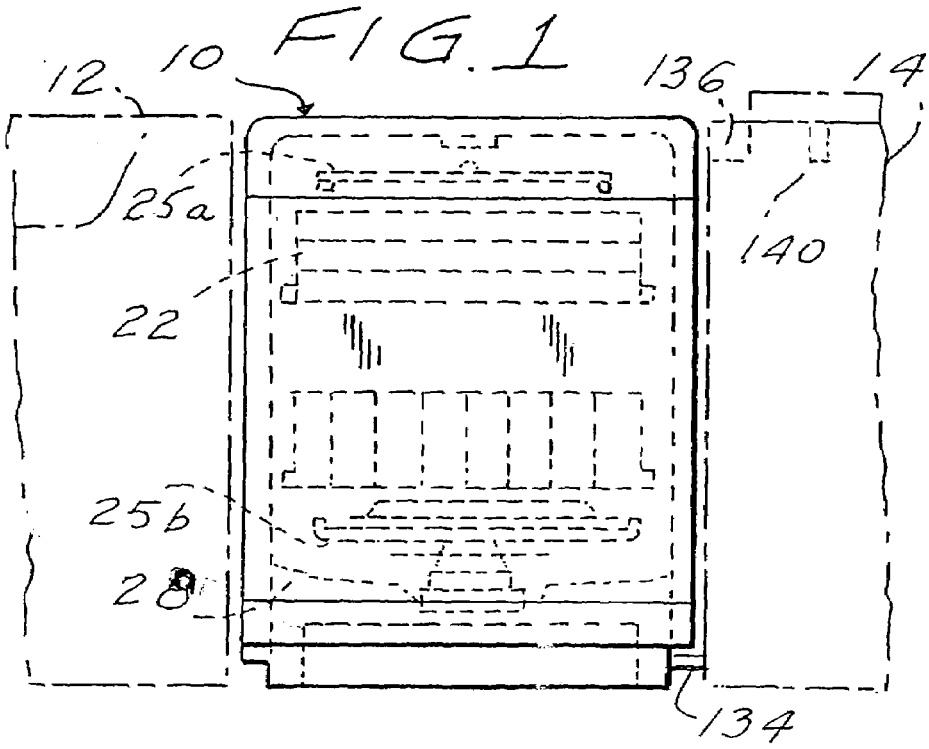
FIG. 1 is a front elevational view of a dishwasher according to the present invention, sandwiched between a sink and a stove shown in phantom line.
Figure 2:
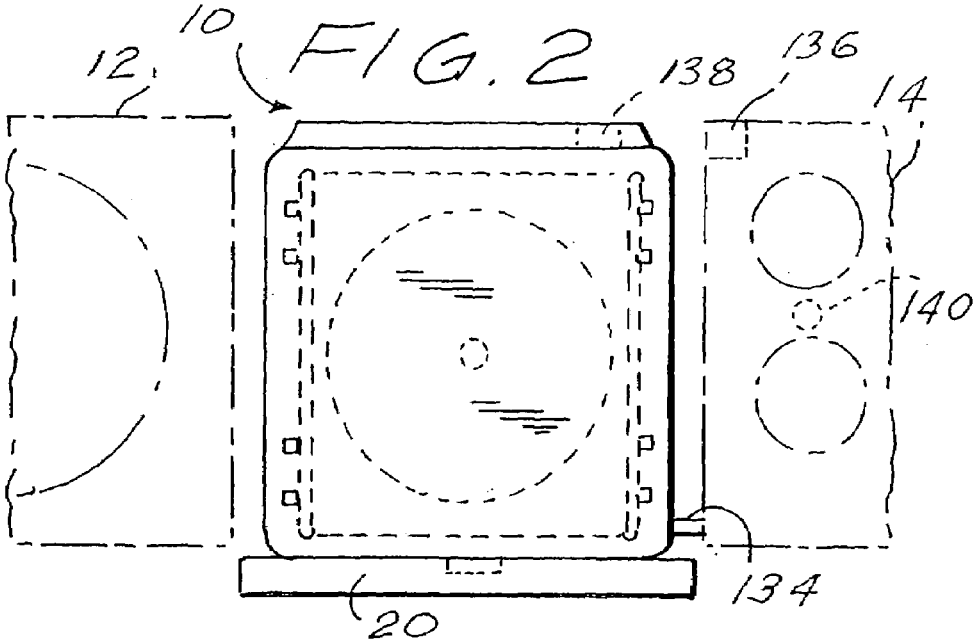
FIG. 2 is a top elevational view thereof.

Referring now to the drawing, and in particular to FIGS. 1 and 2 thereof, therein illustrated in solid line is a dishwasher according to the present invention, generally designated by the reference numeral 10. The dishwasher 10 fits in the normal counter or cabinet space allocated for a U.S. residential dishwasher and is illustrated as being sandwiched between a sink 12 on one side and a stove 14 on the other side, both the sink 12 and stove 14 being illustrated in phantom line.

Figure 3:
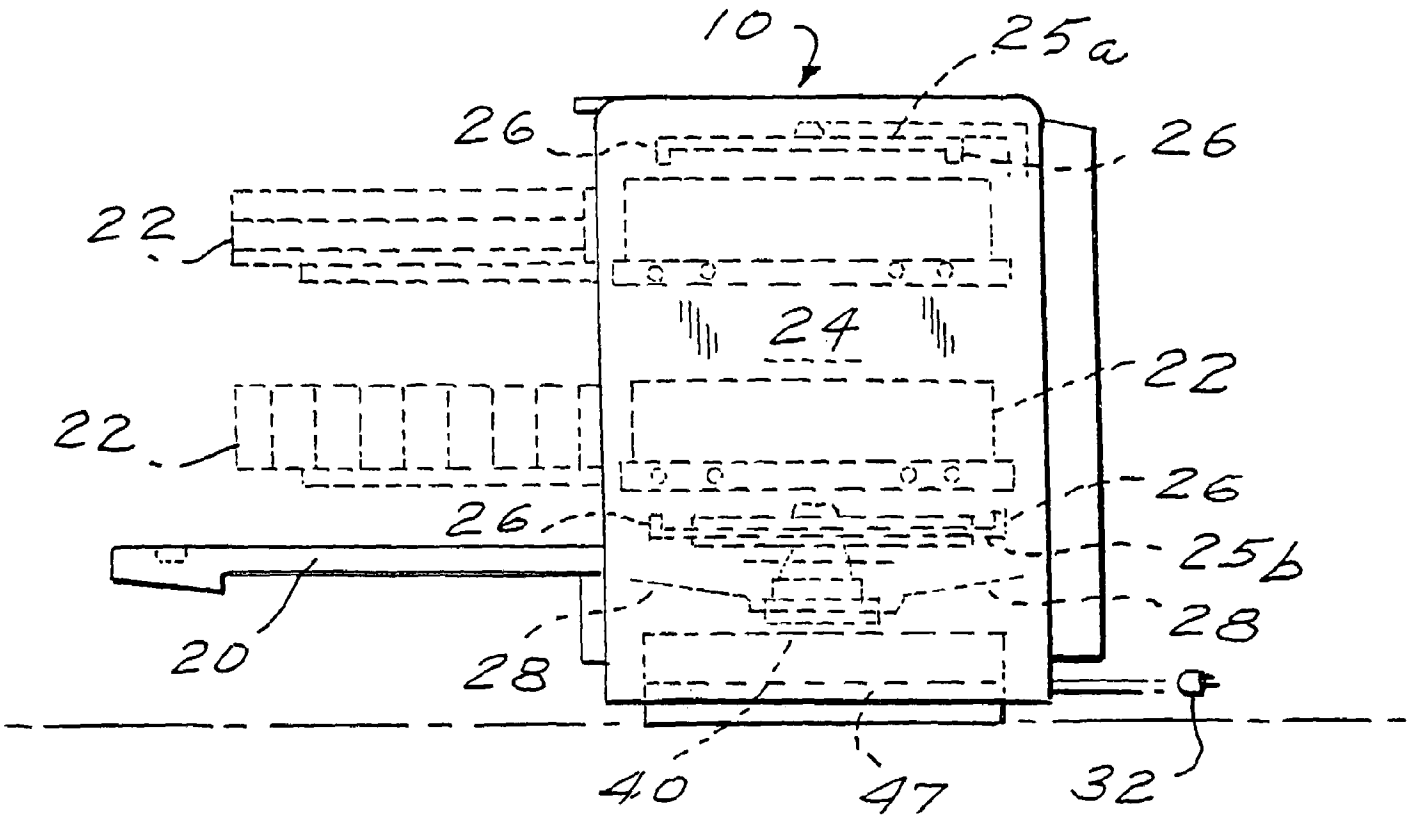
FIG. 3 is a side elevational view thereof with the door open, and both kitchenware holding trays illustrated in phantom line projecting out of the dishwasher.

Referring now also to FIG. 3, therein illustrated is the dishwasher 10 with the front door 20 pivoted to a lowered orientation. Two racks 22 extend at least partially out of the washing chamber 24 for loading or unloading of kitchenware therefrom. The racks 22 are configured and dimensioned to be slidably received within the washing chamber 24 and for holding kitchenware (not shown) such as glasses, dishes, pots, pans, silverware and the like, to be bathed, washed, rinsed and optionally cooled. The racks 22 are illustrated in dotted line in a retracted orientation within the washing chamber 24 and in phantom line in an extended orientation extending out of the washing chamber 24 while the front door 20 is open. The racks 22 are preferably roller mounted for ease of movement into and out of the washing chamber 24. The washing chamber 24 includes a pair of upper spray arms 25*a* and a pair of lower spray arms 25*b*, each arm 25*a*, 25*b* including at least one spray head 26.

A 2- or 3-prong plug 32 is secured to the rear of the dishwasher 10 for receiving power from a conventional U.S. residential power supply—that is, a 110–120 volt, 15–20 amp power outlet (not shown).

Figure 4:
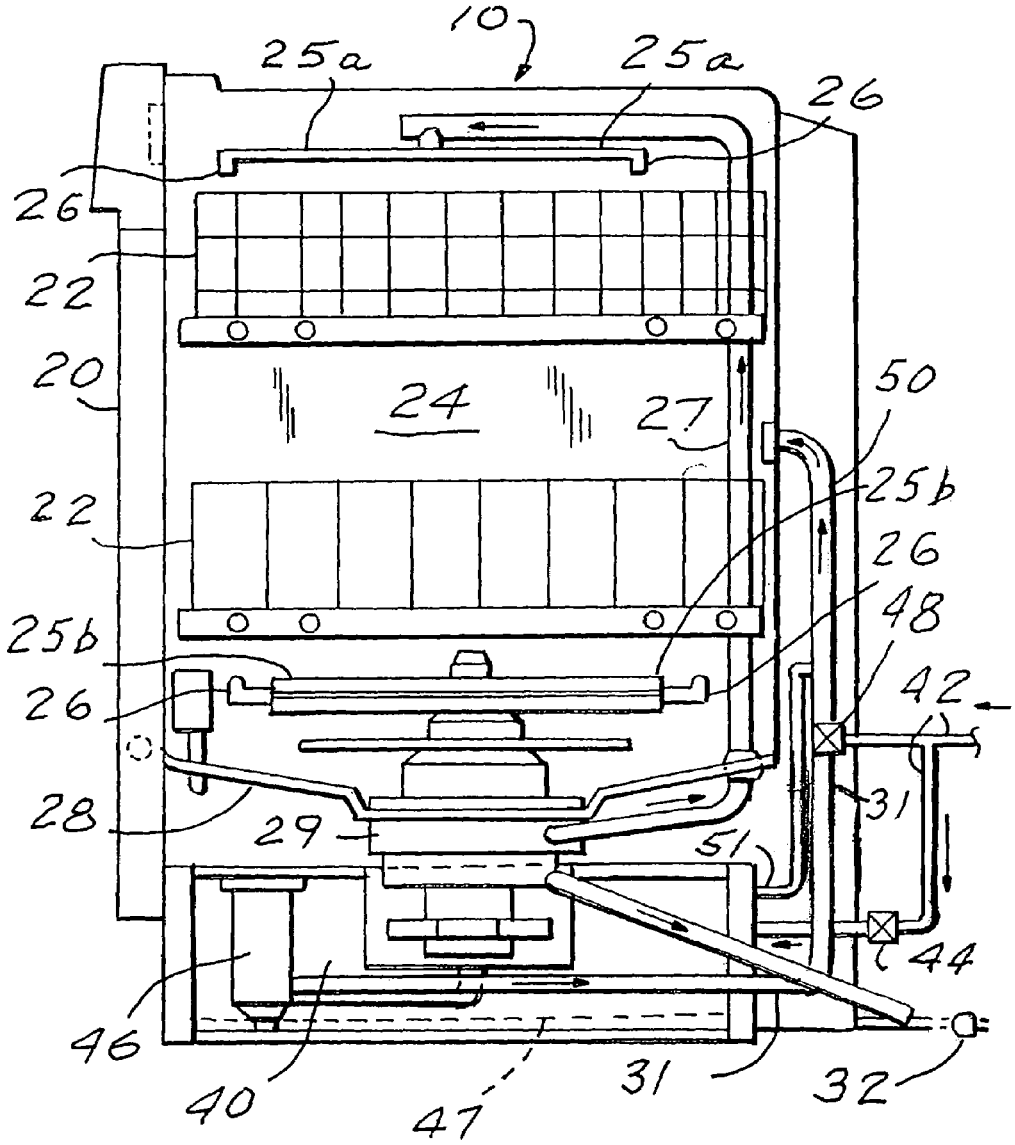
FIG. 4 is a side elevational view of the dishwasher with portions thereof removed to reveal details of internal construction.

Referring now to FIG. 4 as well, therein illustrated is the dishwasher 10, to a slightly enlarged scale, showing the racks 22 slid into the washing chamber 24 and the front door 20 in a raised position to seal the washing chamber 24. A conventional recirculatory and reheating sump 28 allows water (previously introduced into the washing chamber 24 via pipe 50) to be injected through the spray arms 25 and heads 26 to be collected, reheated by the conventional sump reheater (not shown), and then sprayed onto the kitchenware through a sump water recirculation pipe 27 fed by sump pump 29.

A hot water tank 40 is substantially disposed beneath the washing chamber 24 and is generally proximate the floor of the dishwasher 10. Household water (preferably from the hot water tap) is fed into the tank 40 via a hot water tap or supply pipe 42 when the inlet valve 44 is open. Water in a residential hot water line is usually heated, typically to a maximum of 140° F., thereby lessening the load on the heating element 47 within tank 40. Heated water from tank 40 is fed into the dishwasher cavity 24 via tank water discharge pipe 31 and pipe 50.

The tank 40 preferably vents water vapor from within the tank 40 into the washing chamber 24 via vent 51 so that the heat associated with the water vapor is not wasted. Because the tank 40 is preferably vented, it may be made of plastic rather than stainless steel and will generally not require reinforced joints or sidewalls (as it would if it were intended to withstand relatively high water vapor pressure).

Depending upon the particular model of the dishwasher, and more particularly the available space therewithin below the washing chamber 24, the tank 40 is provided with a liquid capacity of about four to about seven gallons of water. The higher levels enable heated water from tank 40 to be used instead of, or added to, tap water for use in a bathe or pre-wash cycle intended to remove loose food particles and the like from the kitchenware. The lower levels do not, thus potentially requiring a longer wash/rinse cycle to bring the kitchenware to the desired temperature. It will be appreciated that the use of heated water from tank 40 (as opposed to tap water) during the bathe cycle is not taken into account in determining the number of HUEs provided, since the applicable standard considers only the HUEs developed after the rinse cycle has commenced, but does affect the surface temperature reached by the kitchenware.

Figure 7:
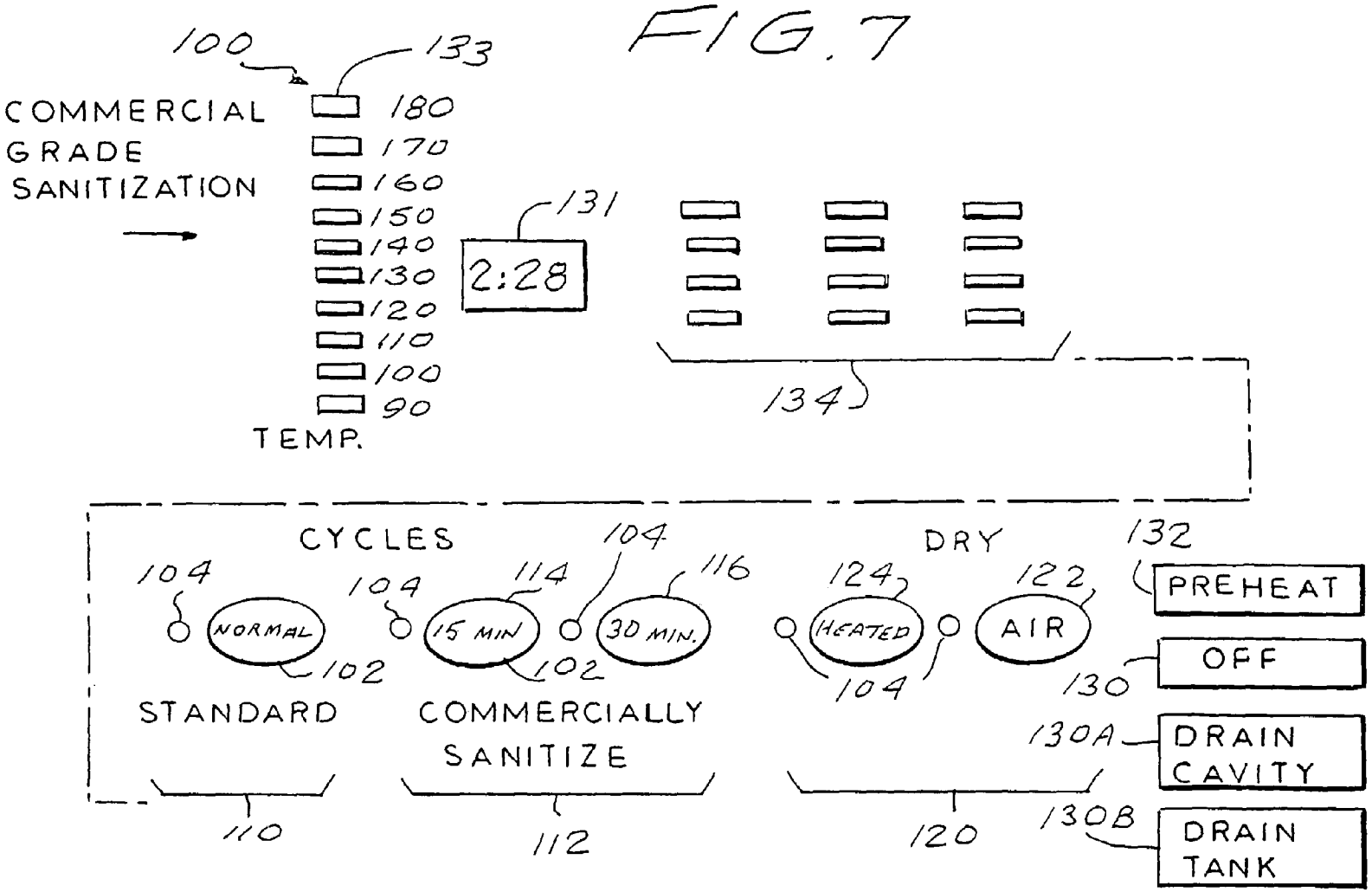
FIG. 7 is a front elevational view of a user interface according to the present invention.

Referring now to FIG. 7, the dishwasher 10 has a control panel, generally designated 100, by means of which the user can provide useful information to the dishwasher and the dishwasher can display information to the user. While a variety of different data entry systems 102 may be used (including knobs, push buttons, and the like), preferably the control panel 100 is touch-sensitive. While a variety of different data display systems 104 may be used, preferably light emitting diodes are used. The display preferably indicates the options which have been selected by the user and the current stage of the dishwasher operation.

In addition to a conventional (60 minute) wash/rinse cycle 110 which is similar to that found in a conventional non-sanitizing dishwasher and does not involve the use of the hot water tank 40, the user can select on panel 100 a commercial sanitization wash/rinse cycle 112, and preferably can choose between a short post-preheat sanitization cycle 114 (15 minutes) and a long post-preheat sanitizing cycle 116 (30 minutes). Both the short and long commercial sanitization cycles 114, 116 involve use of the hot water tank 40 and meet the joint NSF/ANSI standard for commercial hot water sanitizing dishwashers. Both cycles will be described in detail hereinafter.

The user also has the option of selecting on panel 100 the drying mode 120 to be used and, in particular, whether drying should be effected using ambient air 122 ("air") or heated air 124 ("heated"). It will be appreciated that the "heated" option 124 is primarily meaningful in connection with a "normal" or "standard" wash/rinse cycle 110 (that is, one which does not utilize the hot water tank 40). Either of the commercial sanitization wash/rinse cycles leaves the dishware at a sufficiently high temperature that drying is achieved rapidly even with ambient air (unheated). Indeed, the temperature of the dishware is frequently so high that, for safe handling thereof, the use of ambient air ("air") drying 122 is preferred as it serves to cool the dishware to a level permitting comfortable handling thereof during removal from the dishwasher.

The panel 100 additionally includes a user-initiatable "off" selector 130 for draining the water from both the sump 28 and the hot water tank 40 and then ceasing all operation of the dishwasher. The panel 100 may additionally include a user-initiatable "drain cavity" selector 130A and/or a user-initiatable "drain tank" selector 130B. In addition, displays on control panel 100 may include an indicator of the time remaining in the complete cycle (on display 131) and the temperature of the water currently being used during a sanitizing cycle (on display 133), as determined by the temperature of the water in the recirculating sump 28. Various other indicators 134 may be employed to provide the customary dishwasher information to the user—for example, whether or not the dishwasher door is locked, the current function being performed (e.g., preheating, washing, rinsing or drying), whether or not the contents of the cavity are clean (i.e., ready to be removed), etc.—or information unique to the present invention—for example, the special function currently being performed (e.g., "commercial wash," "commercial rinse," or "cycle extended"), whether or not the preheat is completed and the dishwasher is "ready" and holding for a user selection of either the "15 min." and "30 min." wash/rinse cycle, etc.

Figure 5:
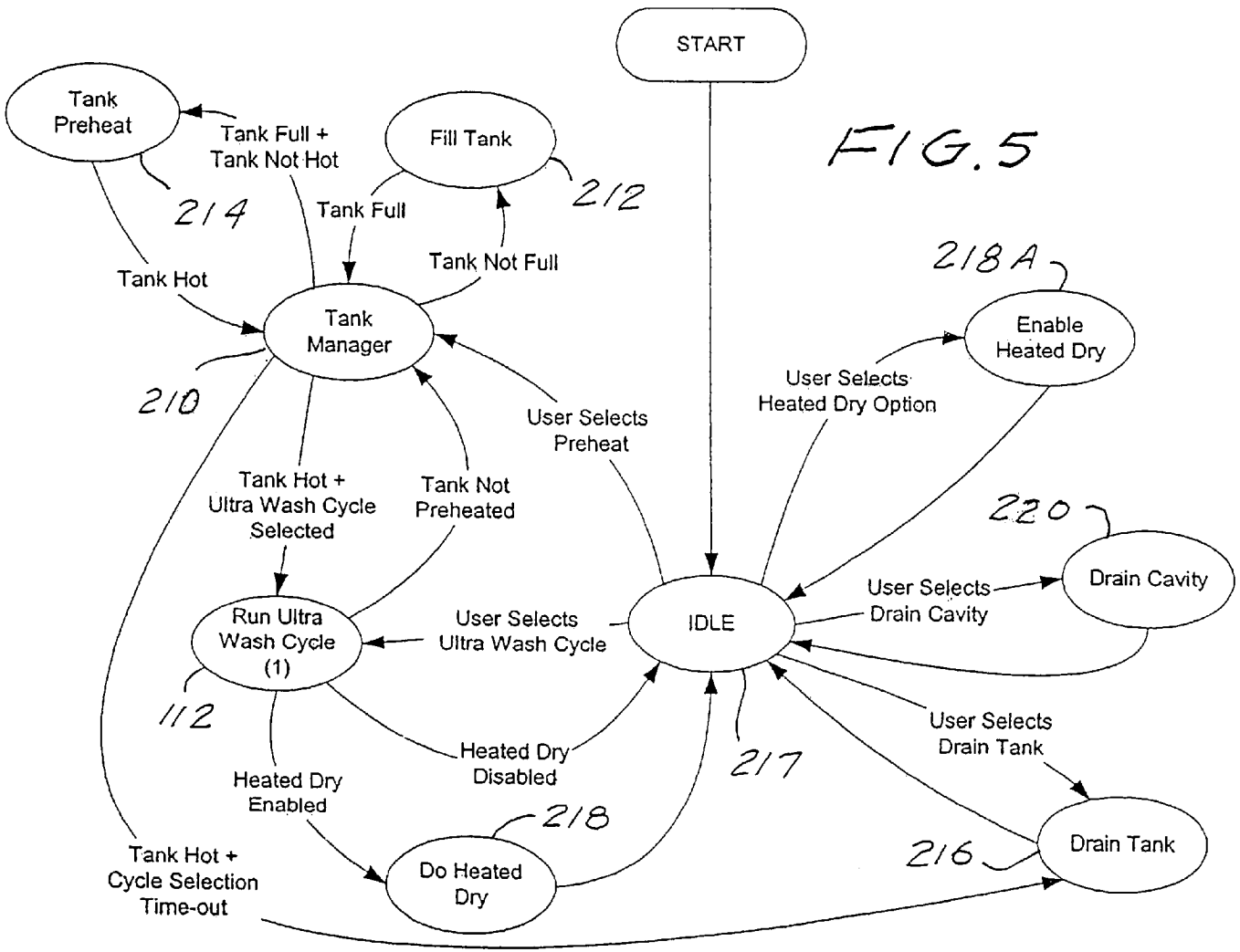
FIG. 5 is a flowchart illustrating the various functions of the dishwasher.

The panel 100 additionally includes a user-initiatable "preheat" selector 132 which can be manually activated by the user to initiate operations involving the preparation of the hot water tank 40 for use. As illustrated in the flowchart of FIG. 5, to be describe in detail hereinbelow, the preparation of the hot water tank 40 for use involves a variety of specific steps. The selection of either of the commercial sanitization wash/rinse cycles has the same initial effect as manual initiation of the preheat mechanism by use of the control panel preheat selector 132. The main difference is that once the preheat has been completed, the selected wash/rinse cycle will begin immediately. However, the use of the preheat selector 132 has the advantage of enabling the user to commence preparation of the water tank 40 for use while still ensuring that the actual wash/rinse cycle will not commence until the user has had an opportunity to load the dishware into the dishwasher 10 and then make a selection of which of the two commercial sanitization cycles 114, 116 is desired.

Referring now to commonly owned U.S. Pat. No. 6,550,448, the substance of which is hereby incorporated by reference, initiation of the preheat mechanism may additionally be effected by actuation of a selected kitchen cooking appliance—e.g., stove 14 (FIGS. 1 and 2)—which is linked to the dishwasher 10 such that actuation of the selected cooking appliance also initiates the preheat mechanism of dishwasher 10. The linking may be done by a simple mechanical or electrical connection 134 or by an over-the-air transmitter 136 associated with the selected cooking appliance 14 and an over-the-air receiver 138 associated with the dishwasher 10. In addition to these previously described linking techniques, the dishwasher may be provided with a remote thermal sensor 140 which initiates the preheat mechanism of the dishwasher when the sensor detects a pre-selected cooking appliance—e.g., stove 14—reaching a pre-selected temperature (e.g., the operating temperature of the pre-selected cooking appliance). Such a sensor 140 preferably incorporates the infra-red technology which has been employed in various devices for determining when food has been cooked to an appropriate temperature and the like.

In any case, referring now to FIG. 5, once the user initiates the preheat mechanism, whether that be indirectly by activation of a linked cooking appliance or directly by use of the panel 100 (e.g., by activation of the preheat mechanism or selection of a "commercial sanitization" wash/rinse cycle), a control mechanism 210 (hereinafter referred to as a "tank manager") prepares the hot water tank 40 for use. The tank manager 210 initially determines whether or not the tank 40 is full and, if not, initiates a fill-the-tank step 212. The filling of the tank is controlled by opening and closing of input valve 44 to adjust the flow from the hot water tap supply 42. If the tank is already full or becomes full, the tank manager 210 then determines whether or not the tank water is at the appropriate temperature, preferably at least 170°–190° F. (preferably 205° F.). If it is not, it initiates a tank preheat step 214. The tank preheat step controls energization of the tank heater 47 as necessary to cause the heated water within tank 40 to reach a preselected temperature. Preferably the tank heater 47 is not actuated until the tank 40 is full and the input valve 44 has been closed. Once the tank 40 is both full and the water therein at the appropriate temperature, the preheat step is completed.

The preheat step 214, after actuation and prior to at least partial deactuation of tank heater 47, preferably operates for no more than 45 minutes, with the pump means 46 discharging heated water from the tank 40 into the washing chamber 24 only subsequent to completion of the preheat step 214.

After the tank manager 210 has deactuated the preheat step 214, at least partial power from the power supply is used periodically, as necessary, for a predetermined period after deactuation (until a cycle selection timeout occurs), to maintain the heated water in the tank 40 at the appropriate temperature prior to the initial discharge of any substantial quantity of heated water therefrom into the dishwasher cavity 24. Accordingly, prior to expiration of the "cycle selection timeout," the tank manager 210 periodically at least partially actuates the tank heater 47 to maintain the water within tank 40 at or about the preselected temperature. Thus, even after the tank preheat step 214 terminates, the tank heater 47 may be at least partially actuated, as necessary, whenever the temperature of the heated tank water drops below a certain value. In other words, the tank manager 210 maintains the dishwasher, for such predetermined period after deactuation, in a state such that it is ready to initiate immediately the first cycle requiring heated water from tank 40—e.g., a bathe cycle (for a large tank embodiment) or a wash cycle (for a small tank embodiment).

After the predetermined period of time has expired without any actuation of a wash operation, it is assumed that the user has decided not to operate the dishwasher at this time, and the dishwasher returns to its off or "idle" state 217. At this point the hot water tank 40 is automatically drained (step 216), so that it can be refilled with fresh tap water prior to its next use. Prolonged maintenance of water at an elevated temperature (for a period substantially greater than the cycle selection timeout) is not considered in accordance with the best of sanitary practice.

Next the tank manager 210 determines whether a sanitization wash/rinse cycle 112 has been selected. If so, the tank manager initiates the appropriate wash/rinse cycle 114, 116 as described hereinafter. As previously noted, if the appropriate sanitizing wash/rinse cycle has not been previously selected or is not selected after a predetermined period of time, the tank manger 210 initiates a drain tank step 216 and then puts the dishwasher in an idle state 217. Preferably the "cycle selection timeout" duration is sufficient to allow for service, eating, and clearing away of a dinner, followed by loading of the dishwasher with the dishware, and at a minimum is the time required for the preheat step. Where the preheat step actuation has resulted from actuation of a linked cooking appliance, the selected period for the timeout preferably additionally incorporates an anticipated cooking time in the linked cooking appliance.

After completion of the selected sanitization wash/rinse cycle 112, to be described in detail hereinafter, the dishwasher goes through a drying cycle, which includes a heated dry step 218 where that option has been selected on the control panel 100 (step 218A), and then returns to the idle state 217. While generally the heated dry option 218 is selected at the same time as the wash/rinse cycle 212, the drying option may be selected or varied any time prior to the end of the selected wash/rinse cycle.

If the user at any time desires to drain the dishwashing cavity 24 (including sump 28) or hot water tank 40, he may actuate the drain cavity option 130A or drain tank option 130B on the control panel 100. The control mechanism responds to this choice by performing a drain cavity step 220 (to remove water from the dishwasher cavity and sump), a drain tank step 216 (to remove water from the hot water tank 40), or both. After the two drain steps 216, 220, the dishwasher turns itself off—i.e., returns to idle state 217.

The dishwasher according to the present invention has at least one of two alternative post-preheat sanitizing cleaning modes corresponding to the two possible implementations of the commercial sanitization standard described above. Each physical embodiment will be capable of operating in at least one of the two alternative cleaning modes. However, typically any given embodiment of the dishwasher 10 is capable of operating, when a commercial sanitization cycle is selected, in only one of the first and second cleaning modes. A preferred embodiment of the present invention is capable of operating in the first cleaning mode, although theoretically a given embodiment could be capable of operating in either mode, depending upon a selection made by the user.

In the first cleaning mode, the kitchenware is washed with water at at least 150° F. during the wash cycle, and the washed kitchenware is then rinsed with water at at least 180° F. during a rinse cycle (typically the last rinse cycle). In the second cleaning mode, the kitchenware is washed with water at at least 165° F. during the wash cycle, and the washed kitchenware is then rinsed with water at at least 165° F. during a rinse cycle (preferably all rinse cycles).

Each cleaning mode provides at least 60,000 Heat Unit Equivalent (HUEs) as defined by the National Sanitation Federation within a 3 minute rinse cycle. During the first cleaning mode the surface temperature of the kitchenware is preferably raised to at least about 175° F. during a rinse cycle, and optimally at least about 175–180° F.

Preferably, during the first cleaning mode, the water leaving the spray head reaches at least 180° F., optimally at least 185°–190° F., in order to ensure that the surface temperature of the kitchenware is raised to the desired sanitizing level. On the other hand, it is preferred that during either cleaning mode (either the first or the second cleaning modes), the surface temperature of any glassware in the kitchenware is raised to above 160° F. for no more than nine minutes or above 150° F. for no more than 20 minutes, thereby to minimize etching of the glassware.

While the control panel 100 affords the user the capability of selecting between two post-preheat wash/rinse sanitizing cycles of a different duration, as a practical matter the 15 minute wash/rinse cycle 114 is satisfactory to the ordinary consumer. The extended or 30 minute cycle 116 provides superior results on a American Home Appliance Manufacturers (AHAM) test primarily used to compare the cleaning performance of different types of dishwashers. The AHAM test is primarily concerned with the removal from the dishware of soil and debris such as eggs, peanut butter and the like. The 15 minute wash/rinse cycle 114 provides satisfactory AHAM score of 70, while the extended 30 minute wash/rinse cycle 116 provides a higher score of at least 80, and, depending on the wash system used, preferably in the high 80's.

The 15 and 30 minute wash/rinse cycles are compared in the Table below:

TABLE

| Cycle | Bathe | Wash | First Rinse | Second Rinse |
|---|---|---|---|---|
| 15 | 3 | 6 | 2.5 | 3.5 |
| 30 | 5.5 | 14.5 | 5 | 5 |

The duration times (in minutes) provided for the bathe, wash, first rinse and second rinse operations include the associated fill and drain times for the dishwasher cavity, each drain time being about one minute and each fill time being about half a minute.

It will be appreciated that the duration times specified in the Table for the various operations represent only the intended duration times. It is critical that a dishwasher which is represented to meet a certain implementation of the sanitization standard achieve the temperatures required by the implementation for the designated period of time.

Accordingly, if the dishwasher control means determines that a given operation takes longer than expected to reach the desired temperature for that operation—e.g., because the dishwasher is overloaded, the water provided by the hot water tap supply is lower then usual, etc.—the duration of the operation is extended until the operation proceeds at or above the designated temperature for at least a minimum designated period of time. To make this determination, the control means monitors the temperature of the water in the recirculating sump 28.

Figure 6:
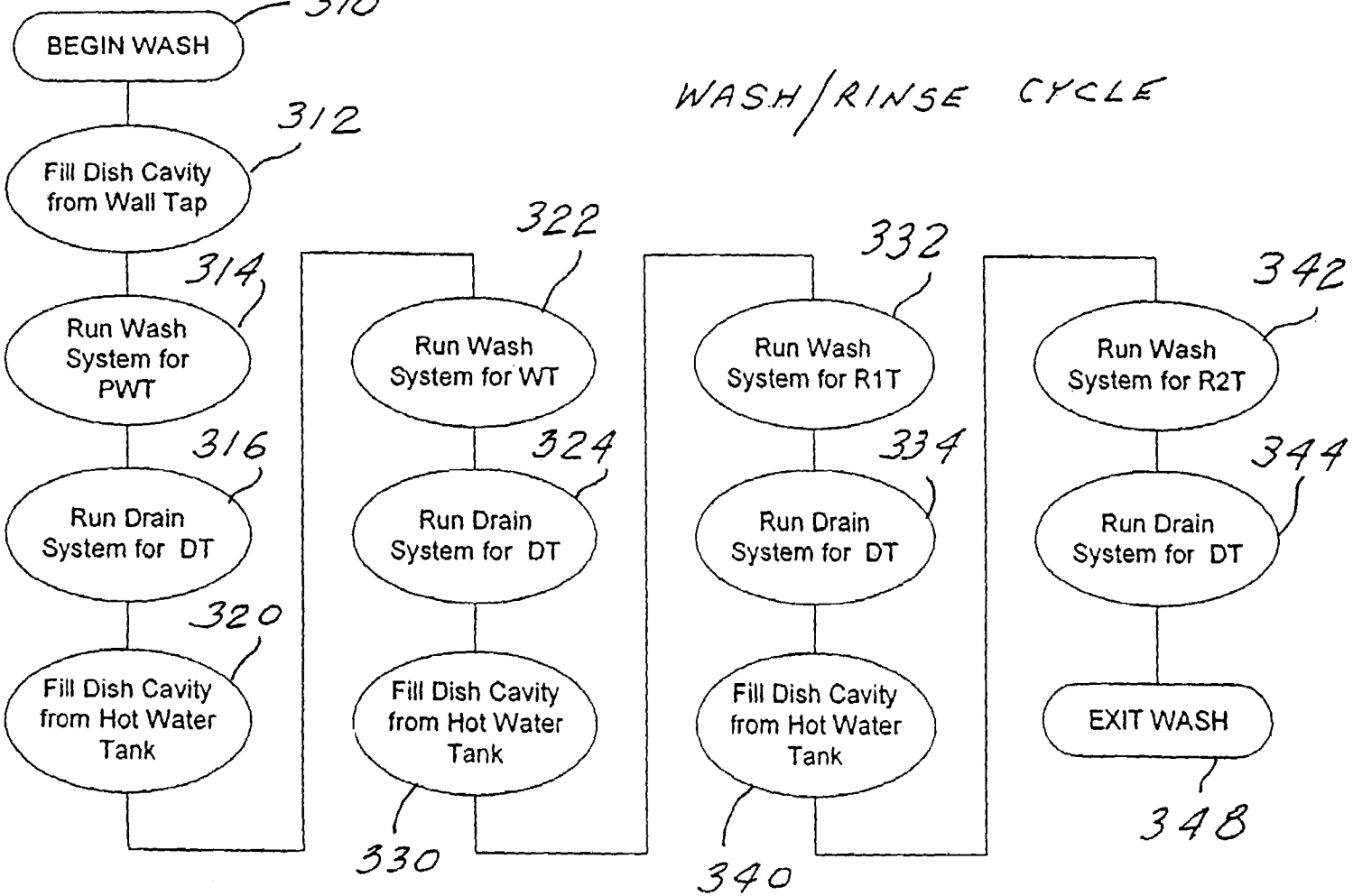
FIG. 6 is a sequentially organized flowchart illustrating the sequence of cycles performed by the dishwasher in a normal operating run.

Referring now to FIG. 6, therein illustrated is a sanitizing wash/rinse cycle for use with a dishwasher with a small hot water tank 40, as described hereinafter. Once the wash/rinse cycle is initiated (step 310), the dishwasher cavity 24 and the conventional recirculatory and reheating sump 28 are filled with hot water from the wall or tap water supply 42 by an open input valve 48 and recirculating pipe 50 (step 312). Valve 48 is then closed. At this time the recirculating system cycle is run for the appropriate bathe or pre-wash time (PWT) which will depend upon the particular sanitizing wash/rinse cycle selected (step 314). During this bathe time, soap or detergent may be introduced and loose particles of food and the like are removed from the dishware in the dishwasher cavity 24. Thereafter, the drain system is run for a drain time (DT) of approximately one minute, sufficient to allow flushing of water and the dislodged food particles from the dishwasher cavity 24 (step 316).

Once the drain step 316 has been completed, the dishwasher cavity 24 is filled with heated water from the hot water tank 40 (step 320) through pipe 50. The recirculating system is then run for a wash time (WT) of appropriate length according to the selected sanitizing wash/rinse cycle (step 322). Thereafter, the drain system again is run for an appropriate drain time (DT) of approximately one minute (step 324). At the beginning of the wash cycle (step 322) soap is generally introduced into the dishwasher cavity through a conventional soap dispensing system.

Next, the dishwasher cavity 24 is again filled with heated water from the hot water tank 40 (step 330), and the recirculating system (but without soap being added) is run for a first rinse time (R1T) according to the selected sanitizing wash/rinse cycle (step 332). Thereafter the drain system is run for a drain time (DT) of approximately one minute (step 334).

The dishwasher cavity 24 is next filled with the remaining heated water from the hot water tank 40 (step 340). The recirculating system is then run for a second rinse time (R2T) according to the selected sanitizing wash/rinse cycle (step 342). It will be appreciated that the second rinse operation (step 342) may be considered an optional cooling cycle if household hot water from supply 42 is used therein. Finally, the drain system is run for a drain time (DT) of approximately one minute (step 344) to finish the selected sanitizing wash/rinse cycle. At this point (step 348) the dishwasher is ready for an ambient or heated air dry cycle.

The sanitizing wash/rinse cycle for a dishwasher with a large hot water tank 40 is essentially identical to the wash/rinse cycle described above for the dishwasher with the small water tank 40, except that the water from the fresh or tap water supply 42 used to fill the dishwasher cavity 24 in step 312 is either replaced by heated water from the large hot water tank or at least supplemented with a limited amount of heated water from the large hot water tank.

Thus, from the perspective of the hot water tank 40, the small tank wash/rinse cycle is considered to be a tap (bathe cycle), followed by a tank (wash cycle), followed by a tank (first rinse cycle), followed by a tank (second rinse cycle), or more succinctly, a "tap/tank/tank/tank" operation. By way of contrast, again from the point of view of the water tank, the large tank wash/rinse cycle is considered to be a tank or at least partial tank (bathe cycle), followed by a tank (wash cycle), followed by a tank (first rinse cycle), followed by a tank (second rinse cycle), or more succinctly, a "tank/tank/tank/tank" operation. It will be appreciated that the difference between large water tank and small water tank embodiments is a structural matter and that therefore ordinarily a given dishwasher according to the present invention can be either a large water tank embodiment or a small water tank embodiment, but is typically not both (although theoretically one could operate a large water tank embodiment in a small water tank embodiment mode).

In the large tank embodiment having a capacity of about 5.5–7.0 gallons, about 1.0 gallon of heated water is pumped into the dishwasher cavity 24 from the hot water tank 40 during the bathe cycle (step 314), about 1.5–2.0 gallons thereof in the wash cycle (step 320), and about 1.5–2.0 gallons thereof in each of the first and second rinse cycles (steps 330 and 340). In the small tank embodiment having a capacity of about 4.5–5.4 gallons, about 1.5–2.0 gallons of hot tap water enter into the dishwasher cavity 24 from the hot water tap supply during the bathe cycle (optimally supplemented by a minor amount of heated water from tank 40), about 1.5 gallons of heated water are pumped into the dishwasher cavity 24 from the hot water tank 40 during the wash cycle, and about 1.5 gallons thereof in each of the first and second rinse cycles. Depending upon the available heated water from tank 40, the second rinse cycle may be performed with heated water from tank 40 supplemented by water from the hot water tap supply.

It will be appreciated that the limited capacity of the small tank embodiment typically precludes the use of tank water for all four cycles of a commercial sanitizing operating cycle. Thus, of the typical four cycles, generally only three use tank water exclusively. A tap-tank-tank-tank combination of cycles has the advantage of removing raw egg and other proteins before they become denatured (i.e., baked on) by the elevated temperatures of the tank water, but result in the kitchenware being too hot for comfortable handling (i.e., removal from the rack) immediately after completion of the sanitizing cycle. On the other hand, a tank-tank-tank-tap combination of cycles has the advantage of leaving the sanitized kitchenware cool enough for comfortable handling (i.e., removal from the rack) immediately after the sanitizing, but has the disadvantage of baking onto the kitchenware raw egg and other denatured proteins such that they are not easily removable. The second option appears more attractive as it is estimated that 80% of dishwasher users rinse the kitchenware prior to it being placed on the racks so that raw egg and other denaturable proteins would be removed before contact with the hot water.

It has been found that the use of the higher sanitizing temperatures in the wash/rinse cycles brings with it several advantages. First, in addition to satisfying commercial sanitization standards, the higher temperature results in a better removal of soil from the kitchenware. Thus, the dishwasher of the present invention not only meets the sanitization standards, but provides superior performance on the American Home Appliance Manufacturers (AHAM) test used to compare the cleaning (soil-removing) performance of different types of dishwashers. Second, the higher temperatures enable shorter wash/rinse cycles to be utilized, thereby making the wash/rinse cycle time of the dishwasher more convenient for the user. Third, because the wash/rinse cycle times are faster (due to the higher temperatures), the glassware is exposed to higher temperatures for a briefer period of time, thereby avoiding or minimizing etching. Fourth, again because the higher temperatures used in the wash/rinse cycles ensure that the spent water leaving the dishwasher is more capable of solubilizing the soil removed from the kitchenware, the higher temperature results in a better discharge of removed soil from the washing chamber of the dishwasher.

While the embodiments of the dishwasher described hereinabove require the presence of an internal hot water tank 40 and a heater 47 therein, an alternative embodiment may utilize, instead of a hot water tank 40, a device identified as a booster/heat sink. Such a device is available from IN-SINK-ERATOR, a division of Emerson. When suitably preheated, such a device is allegedly capable of heating a six-gallon flow of water from 120° F. to 205° F. on the fly. However, the costs, bulk, weight, and fire hazards inherent in the presently available devices of this nature make this alternative problematic for internal use within the dishwasher as an alternative to or replacement for hot water tank 40.

Figure 8:
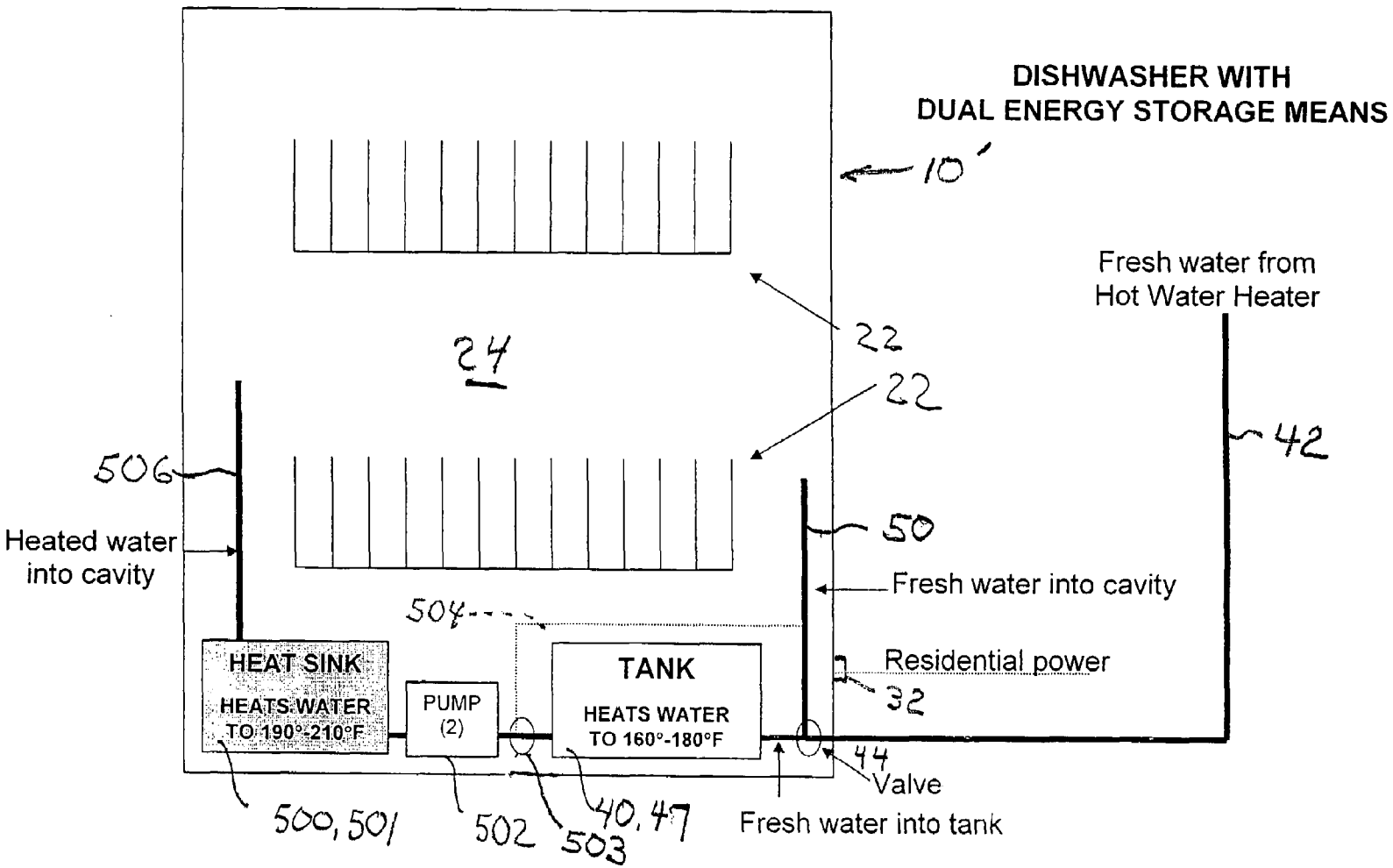
FIG. 8 is an abbreviated schematic of a dishwasher with dual energy storage means illustrating the flow of water into the washing chamber.

On the other hand, a booster/heat sink of lesser costs, bulk and weight finds utility as a supplement to a hot water tank 40. Referring now to FIG. 8, therein illustrated is a dishwasher according to the present invention, generally designated 10', having dual energy storage means. More particularly, the dishwasher 10' is similar to the dishwasher 10 except that a booster/heat sink 500 is disposed intermediate the exit from hot water tank 40 and the entry into the washing chamber 24. Within the hot water tank 40 of dishwasher 10', the fresh or hot tap water from the hot water heater of the residence is heated from not more than 140° F. (and typically 120° F. or less) to only 160°–180° F., as opposed to at least 170°–190° F. Accordingly, the heating element 47 which is used to heat the incoming hot tap water may optionally be of lower cost, bulk and weight relative to that used in the hot water tank 40 of dishwasher 10 (which must heat the water tank to at least 170°–190° F.).

When the water in the hot water tank 40 reaches the desired temperature of 160°–180° F., the outlet valve 503 of the tank 40 is opened and the heated water therefrom is then driven by pump 502 into booster/heat sink 500. Booster/heat sink 500 further heats the heated water leaving the water tank 40 to at least 170°–190° F. (and preferably 205° F.) on the fly. During the preheat cycle, a portion of the energy from the power supply (which would otherwise be used substantially exclusively for energizing the heating element 47 within tank 40) is instead used to preheat the booster/heat sink 500 and in particular the heat storage mass 501 therein (typically formed of stainless steel) to a desired temperature (such as 450° F.) adequate to enable it to perform its function of eventually further heating on the fly the water leaving hot water tank 40 to an appropriate temperature of at least 170°–190° F. (preferably 205° F.) for passage into the washing chamber 24 via pipe 506, during selected ones of the bathe, wash and rinse cycles.

As indicated by the dotted line of FIG. 8, a conduit 504 is optionally provided to divert some of the heated water leaving hot water tank 40 directly into the washing chamber 24 via pipe 50, thereby bypassing the heat booster/heat sink 500. In this manner, the heated water from hot water tank 40 may be introduced directly into the washing chamber 24 or may be mixed with the fresh hot tap water so that the temperature of the flow into the washing chamber 24 from tank 50 is greater than the hot tap water (generally 120°–140° F.) yet less than the heated water introduced into the washing chamber 24 from the booster/heat sink 500 (at least 170°–190° F., preferably 205° F.). Such a "moderately" heated water flow finds utility especially in the bathe cycle and yet can be created with only a minimal drain on the heated water tank 40.

Thus, the dishwasher 10' has dual energy storage means for storing energy from the power supply. The first energy storage means is the water within hot water tank 40, and the second energy storage means is the heated storage mass 501 of heat booster/heat sink 500. Energy is contributed to the dual energy storage means from the power supply during the preheat cycle and is subsequently delivered into the washing chamber 24 (via the heated water). The dual energy storage means thus makes the full power supply available for use by the conventional recirculatory and reheating sump 28 and various non-thermal elements during the post-preheat cycles.

Figure 9:
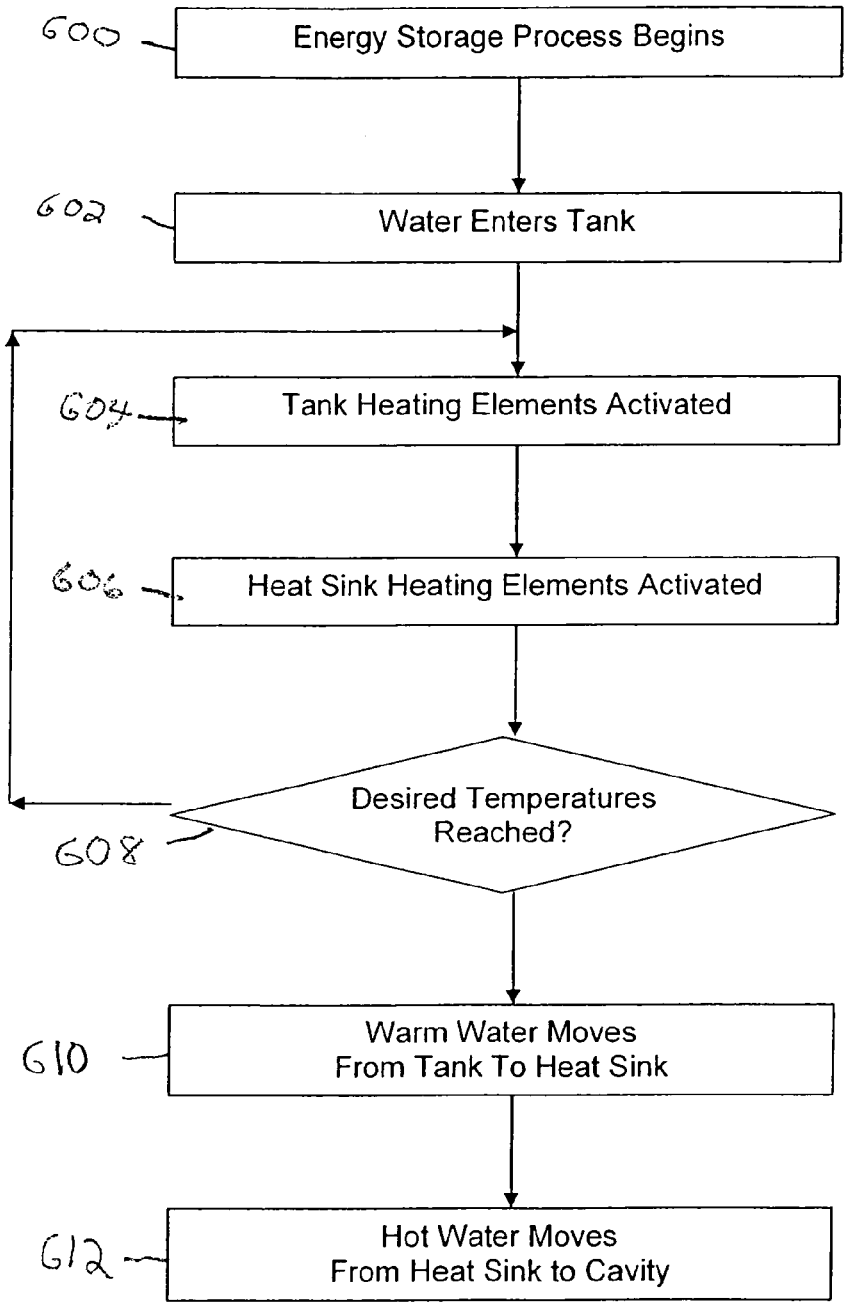
FIG. 9 is a flow chart of the steps involved in the energy storage and distribution process.

Referring now to FIG. 9, therein illustrated is a flowchart for the energy storage process. When the energy storage process begins (step 600), hot tap water enters tank 40 (step 602). The tank heating elements 78 are activated (step 604) and the heating elements of the heat sink 500 are activated (step 606), either simultaneously or successively. The temperature within the hot water tank 40 and heat storage mass 501 of heat sink 500 are monitored until the heated water within tank 40 is at the desired temperature for discharge and the heat storage mass 501 is at the desired operating temperature. When it is determined that both desired temperatures have been reached (step 608), the tank discharge valve is opened and the pump activated to transfer heated water from tank 40 through heat sink 500 (step 610). The further heated water from booster/heat sink 500 is then transferred into the cavity or washing chamber 24 (step 612). Thus, the dishwater 10' includes actuatable preheat means disposed substantially externally of the washing chamber 24 for receiving energy from the power supply during a preheat cycle and for distributing quantities of the received energy as heat into water external of the washing chamber 24 prior to entry of the water at at least 170°–190° F. into the washing chamber 24 during selected ones of the bathe, wash and rinse cycles.

Those skilled in the dishwasher art will readily appreciate that while only a single hot water tank 40 has been described and illustrated in the drawing, there may in fact also be a plurality of supplemental hot water tanks. For example, if the washing chamber 24 of dishwasher 10, 10' is reduced in diameter, free space or a gap is developed between the outer periphery of the washing chamber 24 and the inner surface of the dishwasher enclosure (i.e., housing or cabinet). One or more supplemental water tanks (not shown) may be disposed in such free space. The supplemental water tanks would be in liquid communication with the main water tank 40 (typically disposed beneath the washing chamber 24) to receive heated water from the water tank 40 during the preheat cycle and return the heated water to the water tank 40 upon termination of the preheat cycle (preferably as heated water from tank 40 was delivered into washing chamber 24). Thus, as the supplemental water tanks act merely as extensions of the main water tank 40 to receive heated water from the main water tank 40, store it, and eventually return it to the main water tank 40, they need not have separate heating elements therein (although they may).

It will also be appreciated by those skilled in the art that, while the water tank 40 has been described and shown in the drawing as being disposed underneath the washing chamber 24, if the washing chamber 24 is reduced in size or gaps are otherwise developed between the washing chamber 24 and the interior of the dishwasher enclosure or housing (other than between the bottom of the washing chamber 24 and the floor), the water tank 40 may at least partially occupy such gaps external of the washing chamber 24.

Those households which are not interested in achieving the very high level of sanitization required for a commercial hot water sanitizing dishwasher (that is, the Joint International Standard of NSF/ANSI 3-2001) may be satisfied with the lower standard for a residential hot water sanitizing dishwasher (that is, the Joint International Standard of NSF/ANSI 184-2001). The residential hot water sanitizing dishwasher standard differs from the commercial hot water sanitizing dishwasher standard in that it dispenses with the requirement for the stationary rack machine providing either a 150° F./180° F. implementation or a 165° F./165° F. implementation, but retains the requirement that a minimum of 3,600 HUEs be delivered to the washed dishes in the rinse cycles. While the residential sanitization standard is much easier to meet than the commercial sanitization standard, it must be kept in mind that the conventional dishwasher typically does not produce any HUEs during its normal cycles and takes over one hour to perform even a residential sanitization cycle, if that option is selected.

The dishwashers 10 and 10' described hereinabove are modified to provide—either instead of the commercial sanitizing operating cycle or as an alternative thereto—the residential sanitizing operating cycle simply by changing software or hardware temperature set points. In such a residential sanitizing operating cycle, the heated water still preferably enters the dishwasher chamber 24 at at least 170°–190° F., however the demands of the post-preheating cleaning cycles are relaxed. Accordingly, the dishwasher may have a post-preheat cleaning mode involving washing the kitchenware with water at at least 135° F. during a wash cycle, and then rinsing the washed kitchenware with water at at least 150° F. during a rinse cycle of sufficient duration to develop at least 3,600 HUEs (preferably in less than 6 minutes).

A prime reason why the water is preferably preheated to at least 170°–190° F. (and preferably 205° F.), despite the fact that the wash water need be only at 135° F. and the rinse water need be only at 150° F., is that the heated water being introduced into the washing chamber 24 must be capable of bringing the washing chamber and its contents (including the kitchenware) to an equilibrium temperature enabling subsequent washing at 135° F. and rinsing at 150° F. (Of course, during the various wash and rinse cycles the conventional recirculatory and reheating sump 28 of the dishwasher will be slowly adding its heat energy so that the temperature of the wash water and rinse water will slowly increase with time during the respective cycles.) While the general rule is that hotter water cleans better and faster than cooler water (subject to certain limitations regarding protein denaturation both in food soils and also in detergent enzymes) and kills more germs faster than cooler water, optimum wash temperatures are at least about 135° F. and optimum rinse temperatures are about at least 160° F. Accordingly, the heating of the water to at least 170°–190° F. (preferably 205° F.) during the preheat cycle is generally advantageous.

The complete post-preheat cycle time for the residential sanitizing dishwasher is about 8–14 minutes, including fill and drain cycles totaling about 6 minutes, wash cycles of about 1–4 minutes and rinse cycles of about 1–3 minutes. Accordingly, the residential dishwashers 10, 10' can be modified to provide an additional or alternative cycle which meets the residential sanitizing standard, yet takes substantially less time than the typical at least one hour required by existing dishwashers when utilizing their sanitizing option.

The newly popular "tall tub" dishwasher presents a unique problem as the space underneath the dishwasher cavity is severely reduced. While we have spoken before of the large tank embodiment holding 5.5–7.0 gallons of water and the small tank embodiment holding 4.5–5.4 gallons of water, the capacity of the tank 40 in a tall tub is limited to about 3–4.4 gallons. One solution to this problem is use of the supplemental water tanks described hereinabove (whether with or without separate heating elements therein). Absent such a compensatory mechanism for the smaller size of the storage tank 40, the tall tub dishwasher is unable to meet commercial sanitization-grade standards and can only meet residential sanitization-grade standards.

The preheat cycle for the 3–4.4 gallon storage tank will bring the water therein to discharge temperature in a shorter preheat cycle as there is less water to be brought to discharge temperature. Nonetheless, the lower quantities of water available at the discharge temperature require the use of longer wash and/or rinse cycles to achieve even the residential sanitization-grade standard. For example, a tall tub dishwasher may require post-preheat cycles of about 14 minutes in order to achieve residential sanitization. A preferred operating cycle for the tall tub dishwasher is tap-tank-tap-tank, with only two cycles using the tank water exclusively.

As the "tall tub" dishwasher problem suggests, in particular instances which may arise in the future, it may be necessary to reduce the tank size even further to a "mini" tank embodiment having a capacity generally equivalent to one fill of the washing chamber—that is, approximately 1.5–2.0 gallons of water. The solution to this problem involves the use of a "tank refill". The heated tank water (from the preheat cycle) is emptied into the washing chamber during the initial wash cycle, and the tank is then immediately refilled with tap water and activated to begin heating the newly introduced tap water (i.e., the refill water) to the desired temperature of 190°–205° F. The final rinse cycle is delayed until the refill water in the tank reaches the desired temperature for sanitization of the clean kitchenware. Because only 1.5–2.0 gallons of refill water are being heated, heating of the refill water to 205° F. will take about 21–36 minutes, (depending upon the temperature of the inlet water and the volume of the tank) assuming only 1000 watts of power are used. However, a large proportion (up to 100%) of this refill heating time overlaps the wash and initial rinse cycles, so that the entire post-preheat operating cycle is extended only to about 35–50 minutes.

Figure 10:
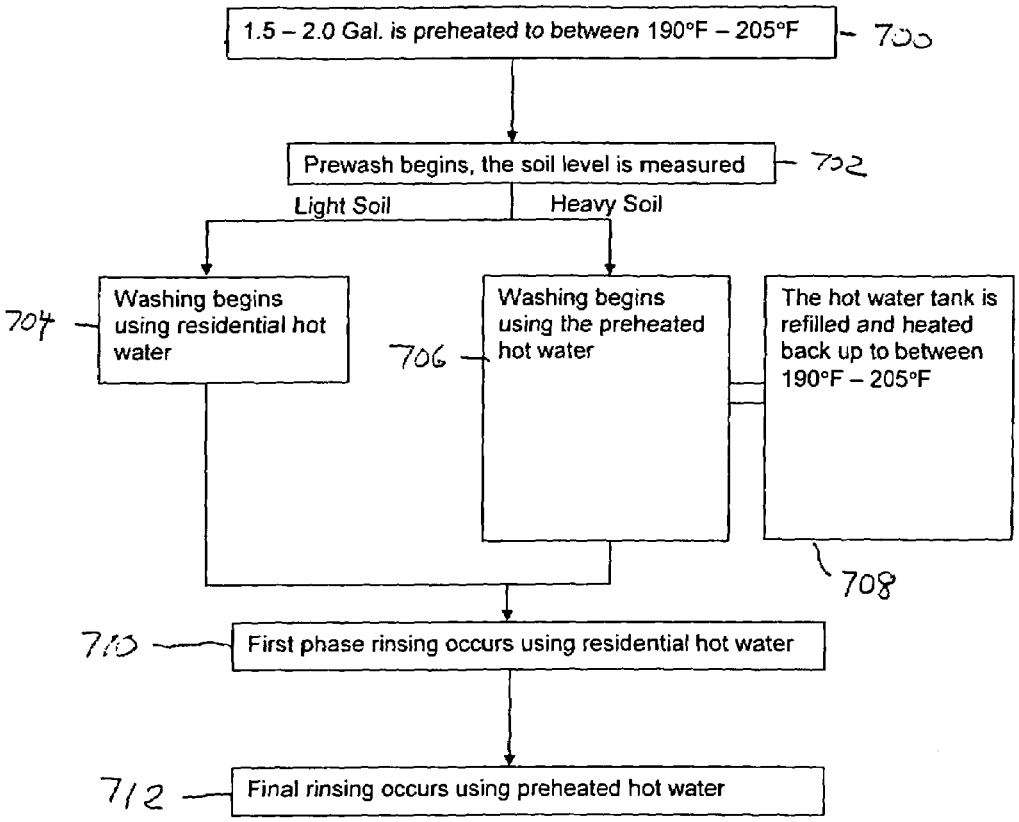
FIG. 10 is a flowchart illustrating operation of a dishwasher having a soil load level sensor.

Referring now to FIG. 10 in particular, therein illustrated is a flowchart for operation of a dishwasher according to the present invention having a 1.5–2.0 gallon capacity mini tank and a soil sensor for measuring the level of soil on the kitchenware. The tank is filled to capacity with tap water, and the water therein is then preheated to between 190°–205° F. (step 700). As the prewash stage begins, the soil level is measured (step 702). If only a light soil load level is detected, washing begins using residential hot water—that is, residential tap water (step 704). Alternatively, if heavy soil load level is detected, a tank refill step is employed—that is, washing begins using the preheated hot water in the tank (step 706), but once the hot water tank is emptied, it is refilled with tap water and heated back up to 190°–205° F. (step 708). In either case, the washing cycle is followed by first phase (initial) rinsing using residential hot water—i.e., tap water—(step 710) and then second phase (final) rinsing occurs using heated water from the tank (step 712). The second phase rinsing of step 712 is necessarily delayed where there has been a "tank refill" step until the refill water is heated to the desired temperature.

The concept of a "tank refill" is also useful where the dishwasher is presented with an especially dirty load of kitchenware such that the normal bathe-wash-initial rinse-final rinse operating cycle of four stages must be expanded to a bathe-first wash second wash-initial rinse-final rinse operating cycle of five stages. Assuming the available tank is only of a 3.0–4.4 gallon capacity, the tank refill concept may be employed to provide a tap-tank-tap-tank-tank operating cycle of five stages. In this instance, instead of the entire tank being discharged during the first wash stage, only about half of the heated water (about 1.5–2.2 gallons) is discharged into the washing chamber at this time, with the remainder (that is, the remaining half of the tank capacity) being retained in the tank at the heated temperature. Immediately after discharge of the first half of the heated water from the tank into the washing chamber during the first wash stage, the half-full tank is filled with additional tap water. As half of the water in the tank is already at the desired discharge temperature (say at 205° F.), the mixture of the already heated water and the refill tap water being introduced into the tank (at not more than 140° F.) provides an overall initial water temperature of about 170° F. for the mixture in the tank. Thus, the heating of water mixture in the tank from 170° F. to 205° F. takes less time than the initial preheat from 140° F. or less (such as about 22–33 minutes, depending upon tank volume) even though less wattage is available for the heating elements in the tank (due to the wattage required to operate the recirculating pump and the like during dishwasher operation). The post-preheat operating cycle for a dishwasher with a tank sized to hold the water for two stages, yet supplying tank-heated water in three stages due to this intermediate fill and heat process, is only about 40–50 minutes. Conventional dishwashers typically require substantially longer—typically as much as about 2 hours for a comparable cleaning of extremely soiled kitchenware.

Soil sensors (sometimes called turbidity sensors) are used in conventional dishwashers to measure the amount of soil present in the wash water during a cycle so that the cycle can be adjusted and thus time and energy are not wasted scrubbing the kitchenware unnecessarily. (The amount of soil to be removed reflects not only the quantity of the kitchenware, but also the level of soiling associated therewith.) One description of soil/turbidity sensor use in dishwashers can be found in U.S. Pat. No. 6,544,344. Some common strategies based on soil measurement include:

changing the number of fills—more water is used to remove heavier soils, changing the temperature of the wash water—higher temperature water removes soil better, and/or changing the length of the cycle—heavier soils require more washing time.

While soil sensors are conventional in the dishwasher art, they are not essential. For example, the consumer may be able to indicate to the dishwasher—for example, by pressing an appropriate button labeled "light load" or "heavy load"—the amount of soil to be removed. Alternatively, there may be different embodiments of a basic dishwasher available for purchase, one designed for light loads and one designed for heavier loads. If, as a result of one of the factors identified immediately above, it is determined that there is only a light load of soil to be removed, then hot water is not needed to scrub the dishes, and, therefore, the preheated water from the tank will not be used in the wash stages of the cycle. The preheated tank water will be used only in the final rinse stages of the cycle so that sanitization of the dishes can occur as fast as possible (about 20 minutes for all four post-preheat stages).

If the dishwasher has not undergone a preheat cycle prior to starting a wash cycle, it can determine the level of soil on the kitchenware during a quick rinse or bathe stage prior to initiating the preheat cycle. If the soil sensor determines only a low level of soil, then the dishwasher need preheat only enough water (one washing chamber fill) to be used for sanitizing the kitchenware in the final rinse stage of the cycle since high temperature water is not required for the wash stages of the cycle. This results in savings in both time and energy since a lesser quantity of water must be brought to temperature by preheating in the tank. On the other hand, if a high level of soil is detected, then the dishwasher will fill and preheat the full capacity of the tank so that heated tank water may be used during the wash stage as well as the final rinse stage—that is, a normal operating cycle will proceed. The use of soil/turbidity sensors in conjunction with water that is to be preheated in the tank as described herein can be efficiently managed and controlled through the use of conventional embedded logic to reduce water usage, total dishwashing time, and energy used during the dishwashing process in a variety of ways, all of which should be readily apparent to those skilled in the art.

A major component of dishwashing is removing or eliminating redeposits of soil from the kitchenware. These redeposits are particles of food that have been removed from the kitchenware and are carried by the recirculating wash (actually, wash or rinse) water and deposited back onto the kitchenware. A common strategy employed in many current dishwashers is filtering the recirculating water to remove small particles of food before they can be carried back onto the kitchenware. However, introducing a filter into the flow of the recirculating water (between the recirculating sump and the washing chamber) creates an obstruction in the flow that causes the wash pressure to decrease, thus resulting in lower cleaning effectivity. The degree of wash pressure loss that results from placing a filter in the flow is directly proportional to the sum of the restricted areas. Therefore, a filter with smaller pore size introduces a larger pressure loss than a filter of equal total area but larger pore size since the mesh of the latter filter consumes less of the total area. Many current dishwashers address this problem of higher degrees of filtering resulting in a larger pressure drop by employing two filters: one filter has a relatively large pore size, and one has a very fine pore size. The majority of the recirculating water passes through the coarse filter, while only a very small amount of recirculating water is passed through the fine filter. The theory behind this strategy is that, if the water is recirculated for a long enough period, then statistically by the end of that period all of the recirculating water will have passed through the fine filter at least once.

Figure 11:
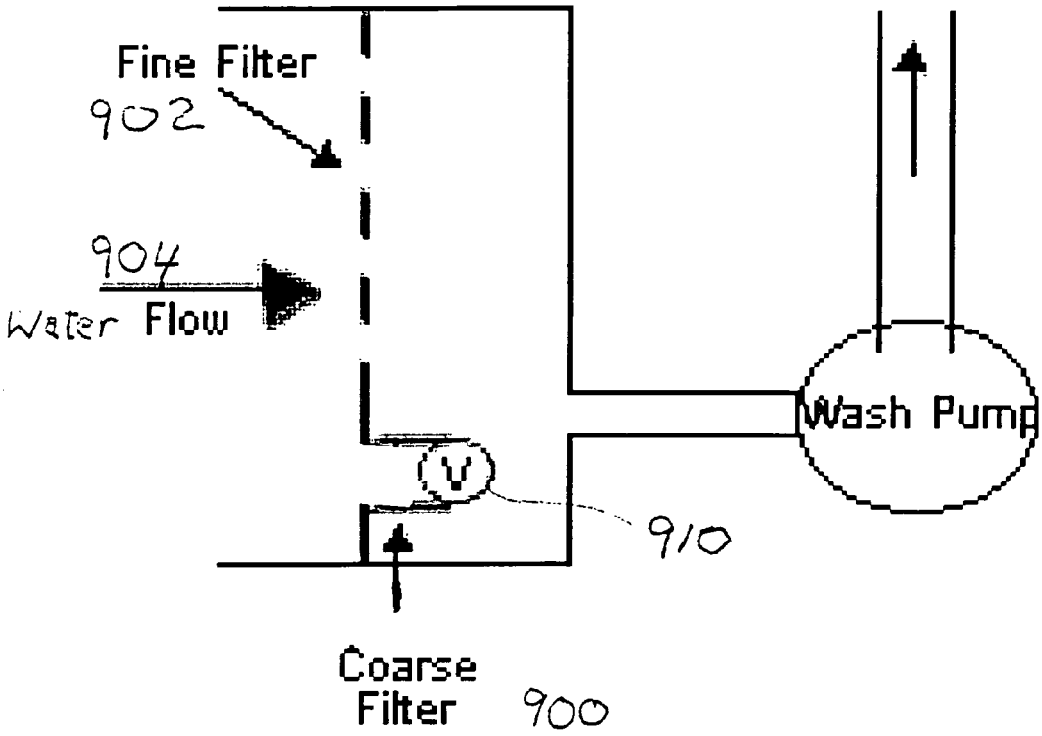
FIG. 11 is a schematic of a filtering system for a fast wash dishwasher.

A dishwasher that is designed for a fast wash cannot rely on a solution that uses extended time to achieve its filtering objectives. Therefore, a unique filtering strategy has been developed to manage the filter/water pressure tradeoff for a fast wash dishwasher. Referring now to FIG. 11 in particular, the unique strategy also uses two filters: a coarse filter 900 and a relatively fine filter 902, in parallel. During the prewash (bathe) and wash stages of a cycle when the higher wash pressures are needed for soil removal, the majority of the recirculating wash water 904 will pass through the coarse filter 900, and only a small amount, if any, will pass through the fine filter 902. However, during the rinse stages of the cycle (especially the final rinse stage), when it becomes critical for the soil particles to be removed from the water, a valve 901 will close the path through the coarse 900 filter, thus forcing all of the water 904 to pass through the fine filter 902. The pressure drop caused by the fine filter is less significant during the rinse stages since the food soil has already been initially removed from the dishes in the wash stages.

This filter strategy for a fast wash dishwasher can be further improved if it is assumed that the rinse water temperature is considerably higher than the wash water temperature, as it is in the fast wash dishwasher of the present invention and in many commercial dishwashers. Under these operating conditions one can use a temperature-actuated valve in the normally open flow path through the coarse filter. The thermostatic valve is immersed in the recirculating water and expands when the temperature of the water reaches rinse water temperatures. The expansion of the thermostatic valve closes the normally open path through the coarse filter and forces the recirculating water to flow through the fine filter.

Alternatively, if a soil load level sensor is present in the dishwasher, a valve responsive to the sensor may be used to close the normally open flow path through the coarse filter and thereby force the recirculating water to flow through the fine filter alone once the sensed soil load level in the recirculating water is low (e.g., during the final rinse cycle).

The unique filtering strategy described hereinabove finds utility in any fast wash dishwasher, regardless of whether or not the fast wash is achieved by using a preheat cycle wherein tap water introduced into an internal tank is preheated to a high temperature as set forth hereinabove. Thus, the unique filtering strategy is useful even in dishwashers where neither residential nor commercial sanitization standards are met.

In addition to the time savings described herein, the present invention provides further benefits to residential dishwashing applications through improved cleaning efficacy. It is well known in the art that higher water temperatures are more effective at removing most soils. By delivering water to the wash chamber at temperatures that are substantially hotter than the temperature at which water enters the wash chamber in the prior art, the present invention achieves superior cleaning efficacy even at temperatures below those required to achieve fast wash and sanitization. For example, by heating the water in the tank to at least 165° F. preferably at least 170° F., prior to discharge into the washing chamber during any of the bathe, wash, initial rinse or final rinse stages, the elevated water temperatures provided by the present invention deliver superior cleaning results within substantially the same time (or a shorter time) as the prior art residential dishwashers.

To summarize, the present invention provides a dishwasher which fits within the conventional U.S. residential dishwasher cabinet space and uses the conventional U.S. residential power supply, but achieves within a convenient cycle time the same standard of sanitization as is set for commercial hot water sanitizing dishwashers. In other words, the dishwasher has a cleaning cycle which is commercially acceptable yet shorter and hotter than the cleaning cycle of the conventional residential dishwasher. The dishwasher in a commercial sanitizing cycle surpasses the joint NSF/ANSI standard for commercial hot water sanitizing dishwashers. Alternatively or additionally, the dishwasher can provide a residential sanitizing cycle in a fraction of the time required by a conventional residential sanitizing dishwasher. The dishwasher is simple and inexpensive to manufacture, use and maintain.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

We claim:

1. A dishwasher comprising:

(A) means for receiving power from a 110–120 volt, 15–20 amp power supply;

(B) a washing chamber including at least one spray head and a recirculatory and reheating sump;

(C) a rack configured and dimensioned to be received within said washing chamber for holding kitchenware to be bathed, washed, initially rinsed, finally rinsed, and optionally cooled;

(D) a water tank disposed substantially externally of said washing chamber;

(E) first means for providing communication between a fresh water supply providing water at no more than 140° F. and said tank, and second means for providing communication between the fresh water supply and said washing chamber during selected ones of the bathe, wash, rinse and optional cooling cycles;

(F) actuatable preheat means for introducing water from said fresh water supply into said tank via said first communication means in a tank fill step and for using power from the power supply to heat the received water in said tank to at least 190°–205° F. prior to commencement of selected ones of the bathe, wash and initial and final rinse cycles;

(G) pump means using power from the power supply for forcing heated water from said tank into said washing chamber for spraying the heated water onto the kitchenware on said rack via said at least one spray head; and (H) means for determining the soil load level of the kitchenware in said washing chamber and, where appropriate, in response thereto modifying the tank fill step.

2. The dishwasher of claim 1 wherein said determining and modifying means, upon determining a low soil load level, modifies the tank fill step such that said actuatable preheat means introduces water from the fresh water supply into said tank via said first communication means only to substantially less than the full capacity of said tank.

3. The dishwasher of claim 1 wherein said determining and modifying means, upon determining a high soil load level, after commencement of a first wash cycle using substantially all of the heated water in said tank, introduces additional water from the fresh water supply into said tank to refill said tank in a tank refill step and then heats the refill water in said tank to 190°–205° F. for use in the final rinse cycle.

4. The dishwasher of claim 3 including means for postponing initiation of the final rinse cycle until the water in said tank is at 190°–205° F.

5. The dishwasher of claim 3 wherein said tank has a water capacity of 1.5–2.0 gallons, and said determining and modifying means introduces and heats the tank refill water to 190°–205 ° F. during at least a portion of the combined duration of the wash and initial rinse cycles.

6. The dishwasher of claim 1 wherein said tank has a water capacity of 3.0–4.4 gallons, and said determining and modifying means, upon determining a high soil load level, after commencement of a first wash cycle using substantially less than all of the heated water in said tank, introduces additional water from the fresh water supply into said tank to refill said tank in a tank refill step and then heats the water in said tank to 190°–205° F. for use partially in a second wash cycle and partially in a final rinse cycle.

7. The dishwasher of claim 6 including means for postponing initiation of the second wash cycle until the water in said tank is at 190°–205° F. after the tank refill step.

8. The dishwasher of claim 6 wherein said determining and modifying means, upon determining a high soil load level:

(A) passes about the half of the heated water from said tank into said washing chamber during the first wash cycle;

(B) replaces the heated water passed from said tank into said washing chamber with additional water from the fresh water supply;

(C) during the first wash cycle, heats the water in said tank to 190°–205° F. for use partially in a second wash cycle and partially in the final rinse cycle; and (D) initiates the second wash cycle, where necessary postponing initiation of the second wash cycle until the water in said tank is at 190°–205° F.

9. The dishwasher of claim 1 additionally comprising:

(I) a filter system including a fine filter and a relatively coarse filter disposed in parallel within the flow path of the water recirculated into a washing chamber by a recirculatory and reheating sump; and (J) channeling means for channeling the water in the flow path through a different one of said filters.

10. A dishwasher comprising:

(A) means for receiving power from a 110–120 volt, 15–20 amp power supply;

(B) a washing chamber including at least one spray head and a recirculatory and reheating sump;

(C) a rack configured and dimensioned to be received within said washing chamber for holding kitchenware to be bathed, washed, initially rinsed, finally rinsed, and optionally cooled;

(D) a water tank disposed substantially externally of said washing chamber;

(E) first means for providing communication between a fresh water supply providing water at no more than 140° F. and said tank, and second means for providing communication between the fresh water supply and said washing chamber during selected ones of the bathe, wash, rinse and optional cooling cycles;

(F) actuatable preheat means for introducing water from said fresh water supply into said tank via said first communication means in a tank fill step and for using power from the power supply to heat the received water in said tank to at least 165° F. prior to commencement of selected ones of the bathe, wash and initial and final rinse cycles; and (G) means using power from the power supply for forcing heated water from said tank into said washing chamber for spraying the heated water onto the kitchenware on said rack via said at least one spray head.

11. The dishwasher of claim 10 additionally including:

(H) means for determining the soil load level of the kitchenware in said washing chamber and, where appropriate, in response thereto modifying the tank fill step.

12. The dishwasher of claim 10 additionally including:

(H) a filter system including a fine filter and a relatively coarse filter disposed in parallel within the flow path of the water recirculated into a washing chamber by a recirculatory and reheating sump; and (I) channeling means for channeling the water in the flow path through a different one of said filters.

13. The dishwasher of claim 10 characterized by completion of its wash and rinse cycles within 30 minutes after loading of the kitchenware into said washing chamber.

* * * * *